US005542563A

United States Patent [19]

Matias

[11] Patent Number: 5,542,563

[45] Date of Patent: Aug. 6, 1996

[54] MODIFIED FLEXIBLE INSERT FOR A GENERALLY RECTANGULAR CONTAINER

[76] Inventor: Carlos J. D. Matias, Av. Paulista 1499, cj 1101/3, Sao Paulo 01311-928, Brazil

[21] Appl. No.: 467,103

[22] Filed: Jun. 6, 1995

Related U.S. Application Data

[63] Continuation-in-part of Ser. No. 83,445, Jun. 28, 1993, Pat. No. 5,421,476, which is a continuation-in-part of Ser. No. 911,722, Jul. 10, 1992, Pat. No. 5,222,621, which is a continuation-in-part of Ser. No. 729,735, Jul. 15, 1991, Pat. No. 5,137,170.

[51] Int. Cl.[6] ..... B65D 88/00

[52] U.S. Cl. ..... 220/470; 220/1.5

[58] Field of Search ..... 220/470, 403, 220/1.5

[56] References Cited

U.S. PATENT DOCUMENTS

| | | | |
|---|---|---|---|
| 2,912,137 | 11/1959 | Taylor | 220/470 |
| 4,461,402 | 7/1984 | Fell et al. | 220/403 X |
| 4,911,317 | 3/1990 | Schloesser et al. | 220/403 X |
| 4,941,589 | 7/1990 | Chen | 220/403 |
| 5,028,197 | 7/1991 | Krein et al. | 220/403 X |
| 5,137,170 | 8/1992 | Matias | 220/1.5 X |
| 5,181,625 | 1/1993 | Podd, Sr. et al. | 220/403 X |
| 5,193,710 | 3/1993 | Podd, Sr. et al. | 220/1.5 X |
| 5,222,621 | 6/1993 | Matias | 220/1.5 X |
| 5,421,476 | 6/1995 | Matias | 220/1.5 X |

*Primary Examiner*—Steven M. Pollard
*Attorney, Agent, or Firm*—Malloy & Malloy, P.A.

[57] ABSTRACT

A flexible insert adapted for simple installation within and simple removal from a container of generally rectangular configuration having a generally planar floor wall, a roof wall, a pair of generally planar side walls, a generally planar front end wall and a generally planar closeable rear door wall, the container having cargo rings mounted about the periphery thereof. The insert including insert portions structured to fit within the container and be unfolded into a floor portion facing the floor wall, a roof portion facing the roof wall, a pair of said wall portions facing the side walls, a front end portion facing the front end wall, and a rear end door portion facing the rear door wall. The insert is constructed to secure at least one of the insert portions to a facing container wall to prevent relative movement therebetween, and including at least one reinforcing strap connected to and extending from the rear end door portion of the insert to at least one of the walls of the container. The reinforcing strap is structured to be unfolded into a taut condition to prevent outward bulging of the rear end door portion when the insert is loaded with cargo and the container rear door wall is open.

18 Claims, 16 Drawing Sheets

FIG. 17A.
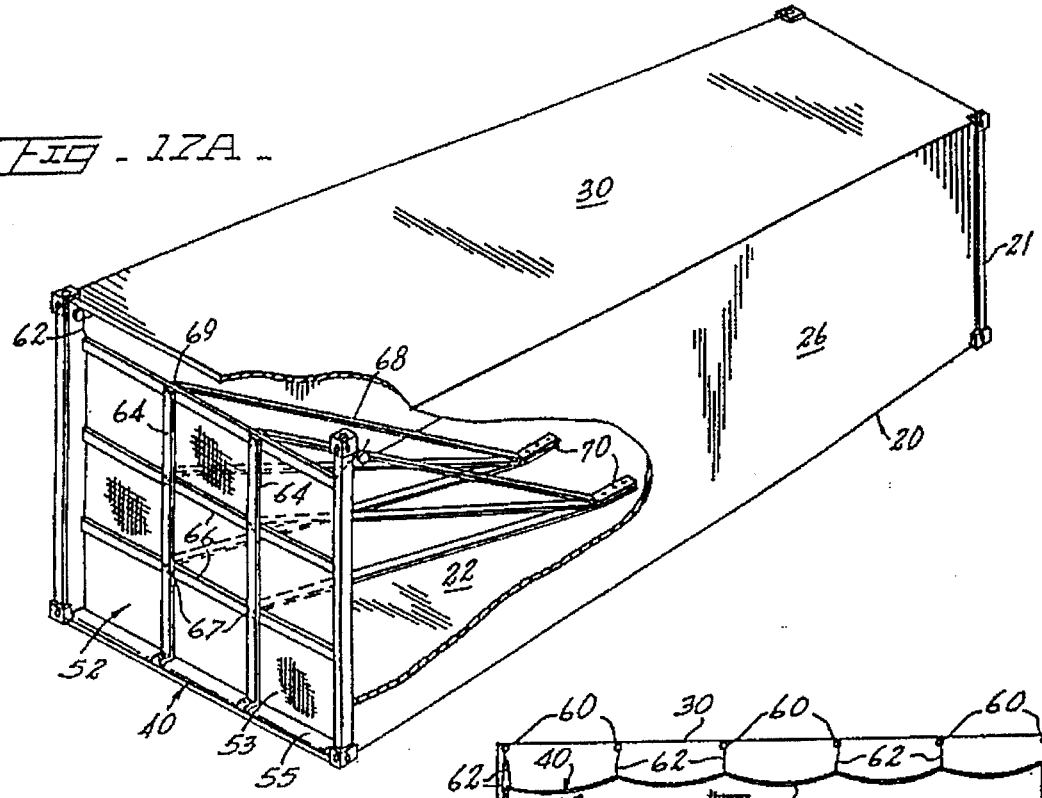
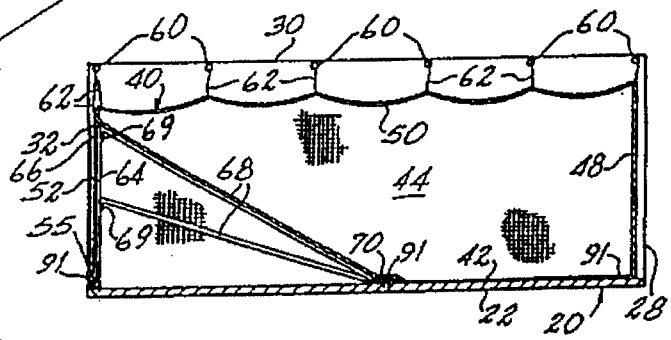
FIG. 17B
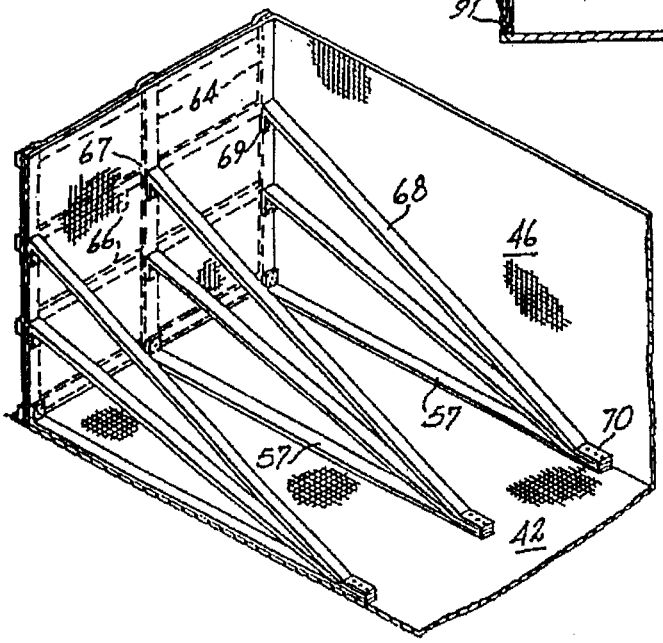
FIG. 18.

MODIFIED FLEXIBLE INSERT FOR A GENERALLY RECTANGULAR CONTAINER

This application is a continuation-in-part of U.S. patent application Ser. No. 08/083,445 MODIFIED FLEXIBLE INSERT FOR A GENERALLY RECTANGULAR CONTAINER filed Jun. 28, 1993 and due to issue Jun. 6, 1995, which is a continuation-in-part of U.S. patent application Ser. No. 07/911,722 MODIFIED FLEXIBLE INSERT FOR A GENERALLY RECTANGULAR CONTAINER filed Jul. 10, 1992, now U.S. Pat. No. 5,222,621, which was a continuation-in-part of application Ser. No. 07/729,735 of Carlos J. D. Matias, filed Jul. 15, 1991 for FLEXIBLE INSERT AND METHOD OF INSTALLATION WITHIN A GENERALLY RECTANGULAR CONTAINER, now U.S. Pat. No. 5,137,170 dated Aug. 11, 1992.

BACKGROUND OF THE INVENTION

This invention relates to the shipment of bulk materials in shipping vehicles and more particularly to a flexible liner suitable for installation in a standard international container or cargo vessel such as a trailer, truck, rail car or air or seagoing cargo storage space together with a method of installing the flexible insert within a generally rectangular container or cargo storage space. The term "container" will be used hereinafter to cover containers, cargo vessels and cargo storage space. The term "bulk material" includes, but is not limited to substances in the form of powder, pellets, flakes or granules, and also includes liquids. Examples of bulk material include coffee beans, salt, grains, and the like.

A large proportion of goods and bulk materials transported today are stored in rigid containers for movement. Many of these containers are of a standard size so that they may be used on both land based vehicles, ships and barges and may also be stacked aboard large seagoing vessels or aircraft. For economic reasons, it has been found desirable to ship bulk materials in containers and in order to do this, a flexible liner has been used in a standard container.

Prior to this invention, flexible containers have been used within standard containers of generally rectangular configuration. However, these containers are susceptible of opening and permitting the load to be lost by spillage when the door to the standard container at one end thereof is opened. There have been cases where laborers working with these containers have been injured during the unloading of the loads stored in these inserts for the standard containers. When cargo is loaded into a flexible insert or when the door of a container provided with flexible insert is opened for inspecting the cargo, the flexible insert bulges outward, making it difficult and even impossible to reclose the door of the container.

Care must be taken insure that the insert within the standard container is not applied in such a manner that it is moveable within the container, because relative movement between the insert and the container may tear the wall of the flexible insert and cause the contents to spill. Unless steps are taken to secure the insert to the container and to provide means to maintain the rear end wall of the inert in close relation to the corresponding rear end wall of the container, problems arise. Spillage of material from a torn flexible insert may contaminate the container and make its further use impossible without first requiring very careful cleaning and scrubbing of the container to remove all vestiges of the contents of a previous load. Also, the flexible insert must resist tearing in cases where direct contact of the bulk material with the container would cause the container to contaminate the bulk material, or vice versa. Also, the flexible insert must be composed of a material that is impervious to the cargo with which the insert is loaded.

Many attempts have been made in the prior art to develop a technique of using flexible inserts for standard size containers.

For example, Taylor U.S. Pat. No. 2,912,137 , issued Nov. 10, 1959, discloses a reusable insert or liner for a container having a floor and four upstanding side walls forming a unitary structure and having a plurality of L-shaped flexible reinforcing elements spaced around the periphery of the structure.

Erickson U.S. Pat. No. 3,402,845 , issued Sep. 24, 1968, discloses collapsible containers of skeleton construction that contain diagonal stays near certain corners of the container. Each stay contains a turnbuckle to facilitate its dismantling or assembly as a rigid connection between adjacent horizontal frame members so that when the stays are rigid, the container opens to receive a load and when the stays are dismantled, the containers collapse for stacking.

U.S. Pat. No. 3,696,952, issued Oct. 10, 1972, and U.S. Pat. No. 3,868,042, issued Feb. 25, 1975, to Bodenheimer, disclose a flexible bag member adhered at spots to an empty container wall which has bulkheads wedged between the container sidewall that move with the insertion of a load of bulk material. The bulkhead is provided with suitable openings that are normally sealed during transport to facilitate loading and unloading of the liner within the container.

Fell, et al, U.S. Pat. No. 3,951,284 issued Apr. 20, 1976, uses a stretchable connector means to support a flexible liner within the adjacent walls of a standard container.

Paulyson et al., U.S. Pat. No. 3,980,196 issued Sep. 14, 1976, discloses a pair of flexible, load distributing, front cross members, a rear frame, and a rear bulkhead mounted on the rear frame to mount and securely retain flexible bag as a liner within a freight container and support the bag against damage or rupture.

Bjelland U.S. Pat. No. 4,054,226 et al, issued Oct. 18, 1977, shows a flexible insert for use within a container. The flexible insert has structural front and rear frames, the front frame retaining the front end of a liner bag in generally rectangular configuration to transmit stresses on the bag to structural members of the container and a laterally curved rear bulkhead supporting the rear end of the bag relative to the standard container to prevent its rupture or collapse during loading or unloading of the flexible insert.

Muller, et al, U.S. Pat. No. 4,232,803 issued Nov. 11, 1980, shows a system that utilizes a pair of retainers to support a flexible liner within a container. This system requires a two door opening.

Riemer U.S. Pat. No. 4,601,405 issued Jul. 22, 1986, discloses a for closing an open end of a cargo holding sleeve used within a standard container. The device consists of three triangular sheets which are respectively connected at a base edge to separate side walls of the sleeve and the apex portions of the sheets are connected together to cooperate to close the end of the sleeve.

Hamada, et al. U.S. Pat. No. 4,792,239 issued Dec. 20, 1988, discloses an adjustable belt for hanging a flexible inner bag to the inner wall of a container.

Krein U.S. Pat. No. 4,863,339 issued Sep. 5, 1989, discloses applying a vacuum between the outer wall of a flexible bag and the inner wall of a container within which the flexible bag is stored for shipment in order to facilitate removing the air between the flexible gab and the container.

European Pat. publication 331,491 to Dorse, published Sep. 6, 1989, discloses a flexible insert bag reinforced by a harness for snug fit within a container.

Lohse U.S. Pat. No. 4,875,596 Issued Oct. 24, 1989, discloses a tubular flexible vessel supported within a container spaced from the container walls and its ends closed by a clamp connection.

Schloesser et al., U.S. Pat. No. 4,911,317 issued Mar. 27, 1990, discloses a bag made of a flexible gas and water impermeable material placed within a 150 type shipping container. The bag has an entry flap positioned adjacent to the door of the container with an air and water resistant zipper sealing the flap with the bag, and having a resealable port for inflating and evacuating the bag to control its interior environment.

Podd et al., U.S. Pat. No. 5,040,693 issued Aug. 20, 1991, discloses a liner for a cargo container that comprises an inflatable body and side connecting straps that are connected to the sides of the inner body and are releasably clamped to the side edge portions of the container floor, using elongated wooden slats over the connecting strips that are nailed to the container floor through the connecting strips.

Krein U.S. Pat. No. 5,059,084, issued Oct. 22, 1991, discloses a flexible liner inserted within a polygonal container to form an interior cavity between the outer surface of the liner and the inner surface of the container. A vacuum applied to the interior cavity shapes the liner to conform to the shape of the container.

A more recent novelty search reported the following publications as relevant to the presently claimed invention:

| | | |
|---|---|---|
| France - 2,461,661 | Kleber-Colombes | June 2, 1981 |
| European - 0,274,417 | Kaisha | July 13, 1988 |
| European - 0,280,493 | Kaisha | Aug. 31, 1988 |
| European - 0,280,495 | Kaisha | Aug. 31, 1988 |
| International - WO 88/09755 | Chick | Dec. 15, 1988 |
| United Kingdom - GB 2,226,300 | Kaisha | June 27, 1990 |
| United States - 4,966,310 | Hawkins | Oct. 30, 1990 |

None of the aforesaid publications incorporate internal obliquely extending reinforcing straps that are constructed and arranged for connection at one end to a rear door portion of an insert at their rear ends and to another portion of the insert to reinforce the rear door portion against outward bulging when the rear door of a container loaded with cargo within said flexible insert is opened. Further, none provide for the effective, adjustable securing of interior straps through side walls of the insert upon cargo rings of the container being variably and irregularly positioned. Also, no where in the art is it taught to provide an insert which will be substantially prevented from sliding towards an open rear of the container upon tilted emptying of the container.

SUMMARY OF THE INVENTION

This invention relates to a flexible insert, of plastic or other flexible material, impervious to the cargo carried, such as canvas or woven jute, that is unfoldable into a shape that approximates the shape of a cargo vehicle or a standard container within which it is applied, the standard container may be suitable for use in an ocean freighter, a trailer for road transportation or a rail car. The invention provides for the safe transport of most bulk materials through a lashing and loading system that suspends the flexible insert from the upper part of a container having several walls including an optional roof wall, a floor wall, left and right side walls, a closed front wall, and a rear end wall comprising one or more doors. The flexible insert of this invention is characterized by a flexible end door portion that is reinforced by obliquely extending strap means that connects the end door portion to at least one of the walls of the container and unfolds to be taut to prevent outward bulging of the end door portion when the container is loaded with cargo and the rear end wall is opened.

The flexible plastic insert of one embodiment of this invention has flexible insert portions corresponding to walls of said container. The insert has suspension means elements, such as a series of flexible straps that cooperate with cooperating suspension means elements carried by said containers, such as a plurality of spaced cargo rings or additional attachment straps, attached to various walls of the standard container for suspending the flexible insert from the container in such a manner that its bottom portion rests in smooth condition on the floor wall of the container while the other insert portions are adjacent other corresponding walls of the container. The mass of the material that is inserted into the flexible insert does not bear on the insert but on the container because the insert rests with its floor wall portion on the floor wall of the container.

Optional insert reinforcement means is provided to reinforce the floor wall portion and/or side wall portion of the insert so that the insert is constructed and arranged to be attached by attachment means, such as nails or screws or the like, through the optional reinforcing means to the floor wall and/or corresponding side walls of the container to prevent relative sliding of the insert with respects to the container. Preferably, front and rear flap portions are provided to reinforce the floor portion of the insert to receive the attachment means that attach the insert to the floor wall of a container. Also, the attachment of cooperating suspension means members, such as straps extending from the outer surface of the insert to corresponding cargo rings or corresponding straps of the container, merely suspends the insert within the volume defined by the container so that the floor portion of the insert rests smoothly on the floor of the container. The optional insert reinforcement means, particularly the rear flap portion, may be omitted if the insert is sufficiently strong to be attached to the container without needing said reinforcement means, or when the floor portion is reinforced with additional floor portion reinforcing means.

The rear portion of one species of the insert comprises an end door portion extending upward from the rear end of the floor portion to reach the upper rear ends of the walls of the container, or, if the end door portion does not extend upward to reach the upper ends and the optional roof wall is present, an optional upper end flap portion extending rearwardly of the rear of the corresponding optional roof portion of the insert may be provided to overlap the end door portion of the insert. The end door portion may be integral with the insert or constructed and arranged to be fixed to the rear end of the floor portion of the insert when the latter is installed within the container.

A plurality of reinforcing straps, preferably comprising vertically spaced, horizontally extending reinforcing straps and a plurality of horizontally spaced, vertically extending reinforcing straps or crisscrossing reinforcing straps arranged angularly other than orthogonal may be provided on the end door portion of the flexible insert and a plurality of internal obliquely extending reinforcing straps are also included to connect the end door portion to one or more walls of the container, preferably the floor wall. These latter straps extend to be taut when the insert is loaded to resist outward bulging of the end door portion. Metal chains or linkages that collapse when folded and extend to be taut when stretched are included in the term "oblique reinforcing straps" within the parameters of this invention.

The upper end flap portion may be omitted entirely if the rear end portion is higher than the load level for the insert. In the latter case, the end door portion of the insert need not extend the entire upward distance to the optional roof wall of the container. However, the upper end portion of the end door portion may have additional straps to secure the end door portion to the upper end of the container such as its optional roof wall or the upper ends of its side walls or end door wall by tying the additional straps to additional cargo rings or suspension straps supported across the width of the upper end of the container near the exit door. When the end door portion is sufficiently high to extend upwardly to reach the optional container roof wall, the upper end of the end door portion is constructed an arranged as an auxiliary flap portion to replace the unneeded upper end flap portion of the optional roof portion and is able to fold upwardly to be sewn to an optional roof portion, and to fold downwardly (either inwardly or outwardly) to provide an air escape passage below the upper end of the container roof wall while the exit door portion below the fold is supported by the oblique reinforcing straps to avoid outward bulging in the reinforced portion of the exit door portion.

Each interior oblique reinforcing strap for the end door portion has a front end connected to one or more walls of said container preferably at its floor wall and/or side wall cargo rings cargo rings fixed to said walls and a rear end secured to the end door portion preferably to at least one of the reinforcing straps in the end door portion. When the container containing the insert is loaded with cargo, the obliquely extending reinforcing straps become taut to support the end door portion in a substantially vertical position to prevent the end door portion of the insert from bulging outward beyond the door of the container. This structure keeps the granular material or liquid that is stored within the insert from bulging out beyond the confines of the container. In addition, various flaps are provided to control which selected portion of the stored material is to be unloaded from the insert within the container. The crisscrossing and preferably horizontally extending and vertically extending reinforcing straps intersect one another throughout the end door portion to provide means for reinforcing the end door portion of the insert and also provides most preferred means for securement to the rear ends of the oblique reinforcement straps that interconnect the end door portion of the insert to other wall portions of the insert and, hence, to corresponding walls of the container, so that the oblique reinforcing straps, when tightly stretched, support the end door portion vertically. The flexible insert is preferably so constructed and arranged that it can be attached directly to a container without requiring an installer to enter the insert during said attachment. The flexible insert must include at least an end door portion subject to outward bulging that the oblique reinforcing straps constrain regardless of the presence or absence of other wall portions in the flexible insert.

In an illustrative embodiment, upper strap means extend upwardly from the front end portion, the end door portion and the side portions of the insert to cooperate with a plurality of cargo rings or attachment straps spaced along the length of the container side walls and walls when no roof wall is present or along the length of the upper front, rear, left and right corner portions formed between the end walls and the left and right side walls on one hard and the optional roof wall of the container and that the flexible insert may be installed in a folded condition within the container with its optional front flap portion or the front of the floor portion resting on the front of the floor wall of the container and the forward part of the floor portion of the insert extending rearward from its optional front flap portion to an intermediate area containing lower forward ends of the oblique reinforcing straps of the preferred embodiment resting flat on the corresponding part of the container floor. After securing the optional front flap portion or the front end of the floor portion and the lower forward ends of the oblique reinforcing straps to corresponding portions of the container floor wall to retain the front floor portion of the insert flat against the front part of the container floor wall, the outwardly extending straps forming insert suspension members of said insert are connected to corresponding cooperating suspension members, such as the cargo rings or attachment straps fixed to said container, to form corresponding cooperating insert suspension members from front to rear with additional floor portion reinforcements, if any, attached from front to rear of the container floor wall securing suspension straps from the insert to cargo rings or other strap attachments of the container and working back, securing any reinforcing flap portions of the insert and the lower ends of the oblique reinforcing straps to the floor wall of the container. Further, in the case of the reinforcing straps extending along through an interior of the insert, at least one portion of the insert includes an adjustable securing port wherethrough the strap is secured to the cargo ring or other strap attachments of the container. Also, to provide additional resistance from bulging a retention loop may be disposed on the end door portion so as to permit one or more of the straps to be looped therethrough subsequent to there being passed through on of the cargo rings. As such, the same strap functions to resist sagging in multiple locations on the end door portion.

The end door portion of the insert is subdivided into a number of end door sub-portions by the crisscrossing of the end door portion reinforcing straps, which are preferably intersecting vertically extending reinforcing straps and horizontally extending reinforcing straps. Each of the end door sub-portions may have readily openable flaps to provide access for selectively unloading a part of the load supported within the insert within the container as desired at a controlled rate of outflow. This manner of locally opening different parts of the end door portion avoids the sudden rush of stored material that can be harmful to personnel working on the unloading job. Also, while the end door portion is preferably an integral part of the insert, it is also within the scope of this invention to have an insert comprising a separated door portion whose bottom end is separately fixed to the rear end of the floor portion to complete the insert during its installation within a container.

Another form of flexible insert consists essentially of a flexible end door portion having upper suspension elements such as flexible straps constructed and arranged for suspension from cooperating suspension elements such as cargo rings or attachment straps, fixed to the upper part of the container, a transverse reinforcement constructed and arranged to receive nails or screws or other attachment means that secure the bottom of the flexible end door portion to the rear end of the floor wall of the container and obliquely extending reinforcing straps interconnecting the flexible rear door portion to an intermediate part of the floor wall of the container so that when the container is filled with cargo and the flexible end door portion of the insert is lifted, the obliquely extending reinforcing straps become taut to counteract a tendency for the flexible end door portion of the insert to bulge outward. This embodiment of this invention does not require that the insert include a front end or side portions or a floor portion or an optional roof portion to be able to resist outward bulging. However, this embodiment is limited for use with materials that do not harm the walls of the container and that can be readily removed from the container before being loaded with another cargo.

The previous embodiment can be modified to incorporate a floor portion resting smoothly on the floor wall of the container. Other optional modifications for the insert include a front end portion, side wall portions, a roof portion and intermediate wall portions that divide the insert into compartments or an intermediate unreinforced flexible insert may be inserted within the container provided with a flexible end door portion or a reinforced insert containing obliquely extending reinforcing straps.

In another modification, the optional roof portion of the insert may be provided with one or more openings that are alignable with corresponding closeable openings in the roof of the container to facilitate loading of the insert from storage means located above the container.

In still other modifications, the flexible insert may be subdivided into insert compartments by one or more flexible longitudinal walls or flexible transverse walls that permit the separate loading and unloading of separate cargos from separate insert compartments.

In a further modification of this invention, preferably longitudinal reinforcement straps are attached to the bottom side edges of an insert, preferably at its bottom side edges, and are attached preferably at the front of the container or cargo vehicle while optional additional insert side wall reinforcing straps extend from approximately the midpoint of the bottom side edges preferably to the front of the container. Additionally, rear door reinforcements straps may be attached to the rear wall portions of the insert and attached together with the front straps in approximately the mid portion of the lower side edges of the insert. The rear wall straps are arranged in an oblique manner to provide reinforcement. This arrangement eliminates internal nailing of the insert of the floor of the container. Further, these longitudinal reinforcing straps, which can extend along all or part of the length of the insert and can be used alone or in conjunction with a number of longitudinal reinforcing straps which extend obliquely from the edge of the insert are preferably secured to a front wall of the container and function to prevent rearward sagging or sliding of the container when a front end of the container is tipped upwardly to unload the cargo through the rear door of the container.

In yet another modification, the rear wall portion of the container is provided with a "funnel" shape to facilitate handling of low density materials and/or for optional usage in vehicles over 30 feed in length.

Still further modifications of reinforcement of the insert rear wall include the use of external straps extending from the container to the insert rear wall portion. Alternately, reinforcing bars associated with the rear insert wall may be deployed transversely of the container.

A further modification includes a simplified suspension and removal system for an insert in which a series of inset rings are attached about the upper and lower peripheries. The insert is easily attached within the container by two fastening straps which are "laced" or otherwise threaded through the insert rings and corresponding cargo rings deployed on the inside of the container. Removal of the insert is readily effected from the rear of the container by severance and removal of the fastening straps.

These and other benefits of this invention will become obvious after a description of a preferred embodiment and certain modifications thereof is studied.

DESCRIPTION OF THE DRAWINGS

In the drawings that form part of a description of various embodiments of this invention.

FIG. 17A is a fragmentary isometric view of a container having an insert consisting essentially of a flexible end door portion and obliquely extending strap means cooperating with said end door portion to fix the end door portion to the container and avoid outward bulging.

FIG. 17B is a longitudinal section aligned on a strap 68 of an alternate embodiment of a flexible insert in which the insert comprises a separate end door portion FIG. 17A interposed between an unreinforced flexible insert and the container.

FIG. 18 is a partial isometric view of an insert wherein its floor portion is reinforced with additional reinforcement straps which may augment or replace one or both of the optional flap portions that reinforce the ends of the floor portion.

DESCRIPTION OF PREFERRED EMBODIMENTS

Figure 21:
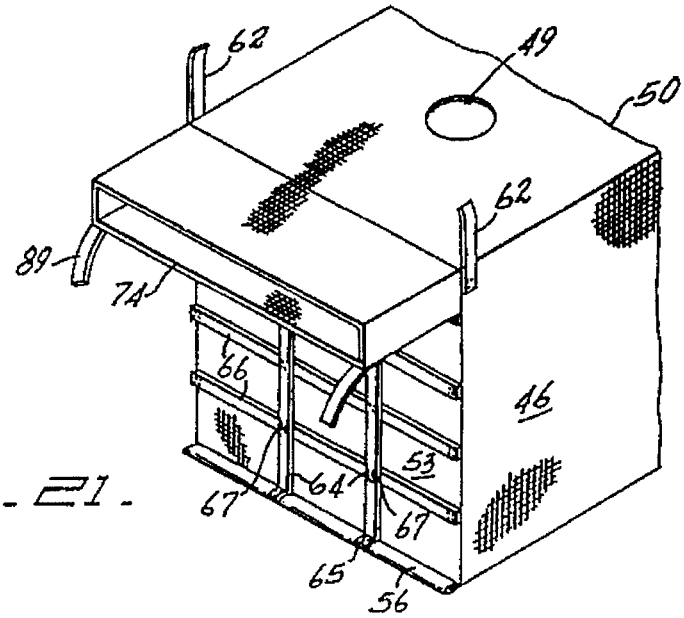
FIG. 21 is an isometric view similar to FIG. 12C showing how an insert may be provided with an aperture in its roof portion.

Referring to the drawings (FIGS. 3, 4, 5 and 7D), a container 20 comprises a metal frame 21 reinforcing a floor wall 22 (composed of metal, wood or the like) from which extend upwardly a right side wall 24 (FIG. 5.), a left side wall 26 and a closed front end wall 28. An optional roof wall 30 that may be solid provided with apertures (FIG. 21) that are preferably closeable, interconnects the upper ends of right side wall 24 and left side wall 26 and also extends from the closed front end wall 28 to a closeable door wall 32. The container is of rectangular cross-section in both elevation and plan and may be associated with a truck, a freighter, a railroad car or aircraft. The walls, roof and floor of container 20 are essentially planar, however, the term "planer" as herein defined includes standard container walls that may be either flat or corrugated shape.

A flexible insert 40 of plastic material of this invention (FIGS. 1 and 2) comprises a floor portion 42 that rests smoothly on the floor wall 22 of the container when installed, a left side wall portion 44 that extends adjacent left side wall 24 of the container, a right side wall portion 46 that extends adjacent the right side wall 26 of container 20, a closed front end portion 48 that extends upwardly adjacent closed front end wall 28 of container 20, and an optional roof portion 50 that extends substantially coextensively below optional roof wall 30 of container 20. Roof portion 50 may extend at its rear end into an optional upper end flap portion 51. An end door portion 52 extends upward from the floor portion 22 of insert 40 inside door wall 32 of container 20 to terminate at or below the rear end of the upper edges of side walls 24 and 26 when installed.

End door portion 52 is sub-divided into end door sub-portions 53 in a manner to be described later. The optional upper end flap portion 51, which extends outwardly beyond roof portion 50 when included, forms a flap that is selectively closed or open, the open position being depicted in FIGS. 1 and 2. Upper end flap portion 51 may be omitted, particularly when a cargo supplied to container 20 does not fill the container completely, thereby leaving opening above end door portion 52 to exhaust air from the interior of insert 40 when cargo is inserted. End door portion 52 is constructed and arranged to extend upward from floor portion 42 sufficient distance to enclose a cargo that is partial load or a full load for insert 40. Under these circumstances, upper end flap portion 51 is superfluous and added suspension straps 62 are provided to support the upper end portion of end door portion 52 from additional cargo rings 60 or additional suspension straps 62 fixed to container 20. End door portion 52 is preferably a unitary part of insert 40, but may be provided with a transverse flap 55 (FIG. 17A) through which end door portion 52 is attached to the rear end of floor portion 42 or directly to floor wall 22.

Figure 11:
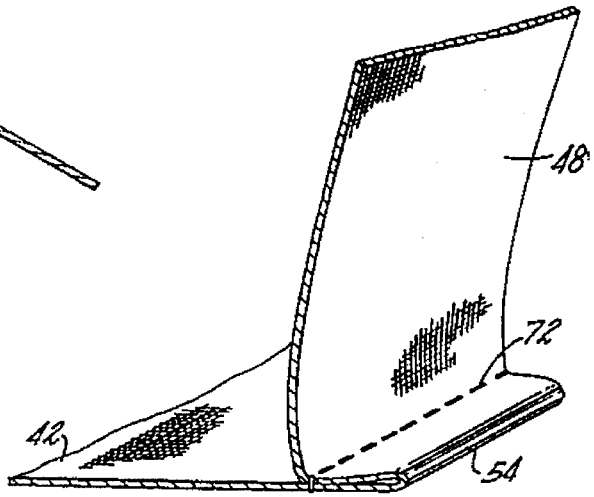
FIG. 11 is an isometric enlarged view of a portion of the closed end wall portion of the flexible insert near the end of its floor portion to show how a folded optional front flap portion interconnects the floor portion of the insert to its front wall portion.

Floor portion 42 is reversely folded and seen at 72 (FIG. 11) at its forward end to form an optional front flap portion or transverse reinforcement 54 that connects the front end of floor portion 42 and the lower end of closed front wall portion 48. An optional rear flap portion or transverse rear reinforcement 56 is similarly reversely folded and sewn to form an extension of the rear end of floor portion 42 that is curved upward into the lower part of end door portion 52. The number of reversing folds for front flap portion 54 and rear flap portion 56 need not be limited to the two shown in the figures as long as the flap portions are strong enough to receive securing means, such as nails, screws and the like, that secure the flexible insert 40 to the floor wall 22 of container 20 and maintain floor portion 22 smooth, as will be described later. Alternatively or additionally, to fix insert 40 to contain 20, left and/or right side portions 44 and 46 may be fixed to corresponding left and/or right side walls 24 and 26, respectively. Longitudinally extending reinforcing straps 57 (FIG. 18) may be attached to extend lengthwise of floor portion 42 to reinforce the latter for further attachment to floor wall 22 and may even make it unnecessary for front flap reinforcement 54 and/or rear flap reinforcement 56 to be included.

Figure 8:
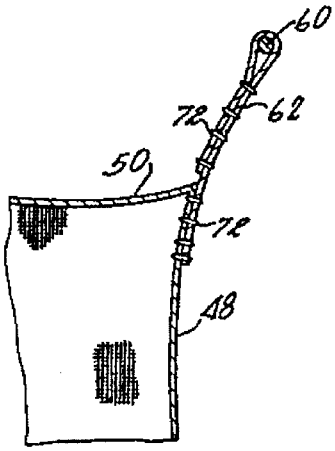
FIG. 8 is an enlarged sectional view of the upper right hand corner of the view of FIG. 7B illustrating one type of top strap for securing the upper right corner of the optional roof portion of the insert to the upper right portion of the optional roof wall of the container within which the insert is installed.

At the upper portion of the container 20 along the upper edges of each of the side walls 24 and 26 and optionally, front end wall 28 and door wall 32, a plurality of insert suspension members, such as longitudinally spaced cargo rings 60 and/or attachment straps (not shown) are arranged from innermost (forward) to outermost (rearward) rings. A cooperating insert suspension member, such as a flexible top strap 62 that may be constructed of reinforced fabric, such as used in automobile seat belts, is provided on insert 40 for as many of cargo rings 60 as needed. Preferably a unique strap 62 is provided for each cargo ring 60. A typical arrangement is shown in FIGS. 7A through 7D. FIG. 8 shows how a typical top strap 62 is sewn at 72 into an upper portion of closed wall portion 48 and looped through a top cargo ring 60. Additional top straps 62 arranged from innermost to outermost straps to correspond to the positions of cargo rings 60, are connected to extend upwardly from side portions 44 and 46 and are threaded through top cargo rings 60, then sewn together at 72 to form loops extending through corresponding cargo rings 60 so that the flexible insert 40 is suspended from the upper end of container 20 with floor portion 42 resting smoothly on floor wall 22 of container 20.

Figure 9:
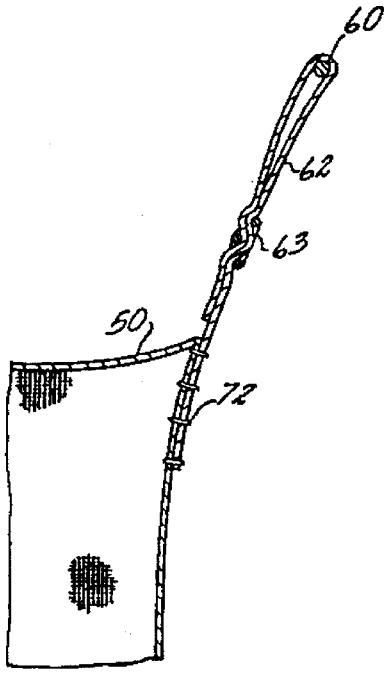
FIG. 9 is a view similar to FIG. 8 of an alternate embodiment of a top strap that incorporates a buckle.

FIG. 9 shows an alternative embodiment of top strap 62 in which the strap is adjustable in length through the use of a buckle 63 through which strap 62 is threaded.

Figure 1:
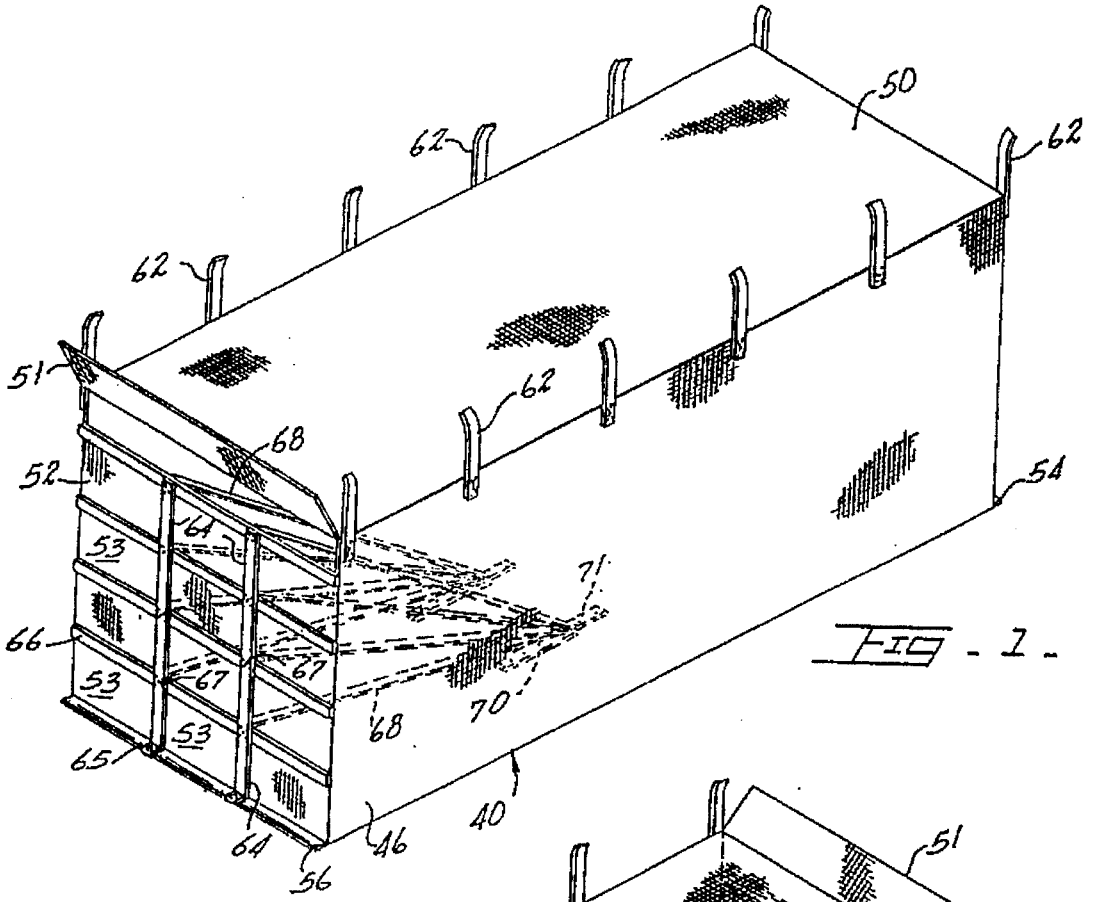
FIG. 1 is an isometric view of a flexible liner showing its shape when inserted within a rigid container and looking from the rear of the door portion of the flexible insert.

End door portion 52 is sub-divided into a plurality of end door sub-portions 53 arranged in checkerboard arrangement shown in FIG. 1. Sub-portions 53 are defined by a plurality of crisscrossing reinforcing straps, preferably horizontally spaced vertical reinforcing straps 64 having lower end 65 fixed to optional rear flap portion 56 or the rear end of floor portion 42 by sewing and vertically spaced horizontal reinforcing straps 66 that form intersections 67. Thus, sub-portions 53 are arranged in horizontally extending tiers. Crisscrossing reinforcing straps may extend in directions other than horizontal and vertical without departing from the gist of this invention.

Figure 6:
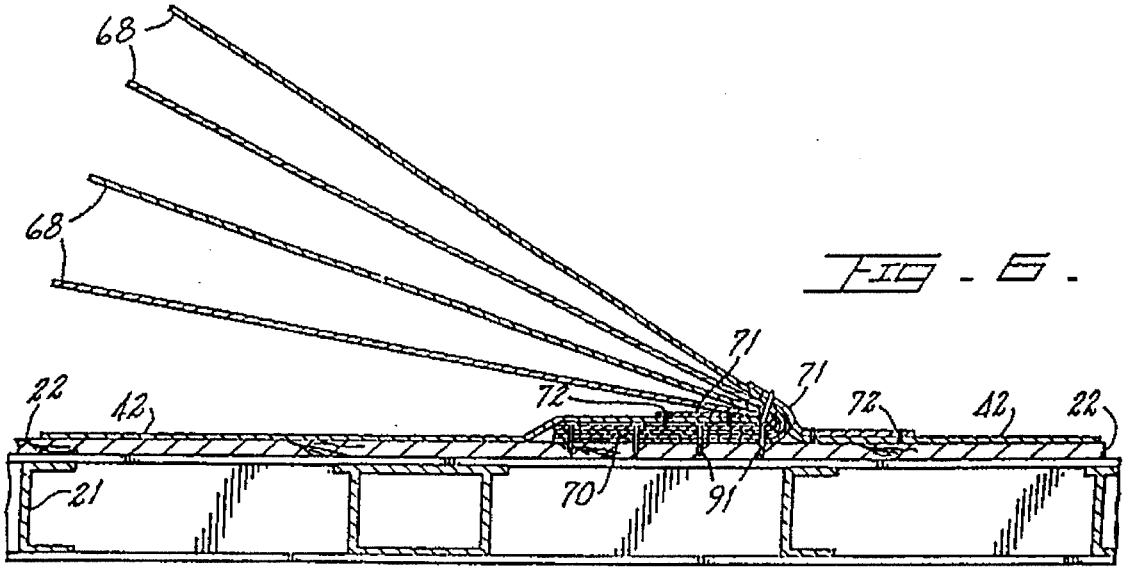
FIG. 6 is an enlarged view of a portion of FIG. 3 showing in detail how one of the arrangements for attaching the lower end of one set of interior oblique straps to the floor portion reinforcement of the insert is arranged.
Figure 7A:
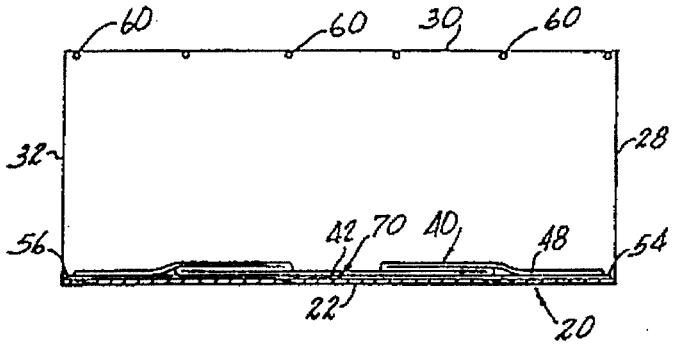
FIGS. 7A, 7B, 7C and 7D are series of schematic elevational views showing different steps during a preferred method of installing a flexible liner of this invention within a cargo container.
Figure 7B:
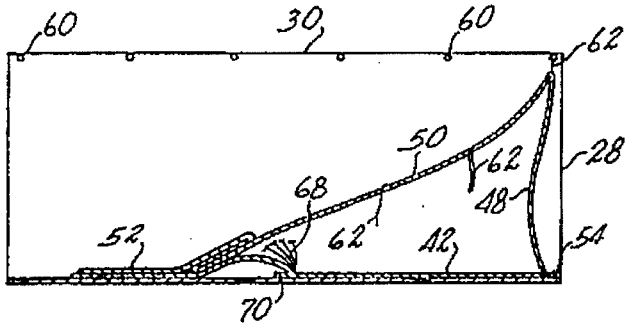
Figure 7C:
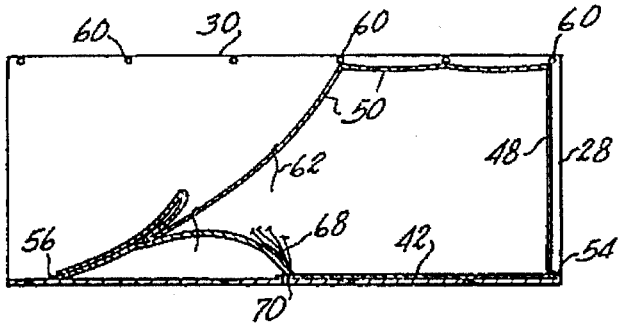
Figure 7D:
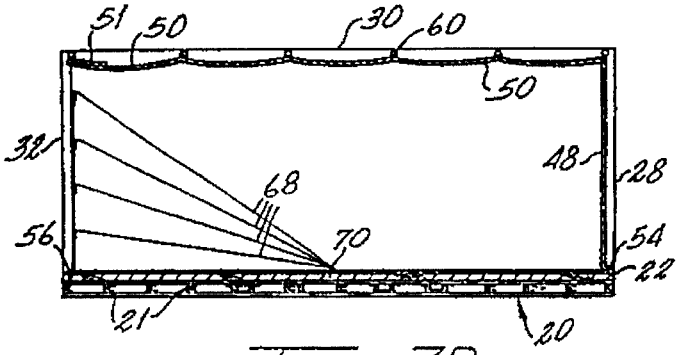

Flexible insert 40 is provided with a plurality oblique reinforcing straps 68, each having a downwardly folded upper rear end 69 and a rearwardly or forwardly folded forward lower end 70. The upper rear end 69 of each oblique strap 68 is folded downward and attached to end door portion 52, preferably to a vertically extending reinforcing strap 64 and a horizontally extending reinforcing strap 66 at a unique intersection 67 for each oblique strap 68. The lower end 70 of each obliquely extending reinforcing strap 68 extends through a slot of a series of spaced slots in floor portion 42 and is shown folded to the rear for attachment to floor wall 22. Flap means 71 is provided to close any slot receiving the folded lower end 70 of each oblique strap 68 and to reinforce floor portion 42 further in the vicinity of each strap receiving slot. Flap means 71 are sewn to floor portion 42 and 72 in FIG. 6. FIG. 6 also shows in detail how a typical attachment of oblique reinforcing straps 68 is made through their lower ends 70 and nailed at 91 to container floor wall 22. The areas of attachment of lower end 70 to container floor wall 22 may form an arrangement having a regular pattern or may form a random arrangement.

Figure 10A:
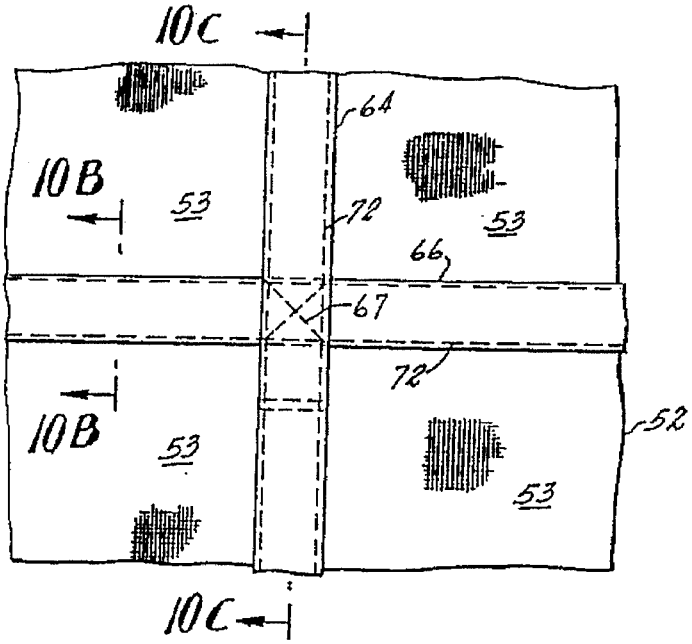
FIG. 10A is a fragmentary elevational view of a localized portion of an end door portion of the flexible insert.
Figure 10B:
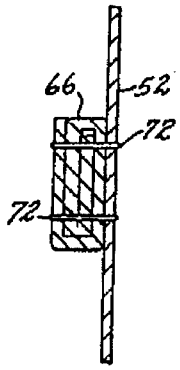
FIG. 10B is a view taken along the lines 10B—10B of FIG. 10A.
Figure 10C:
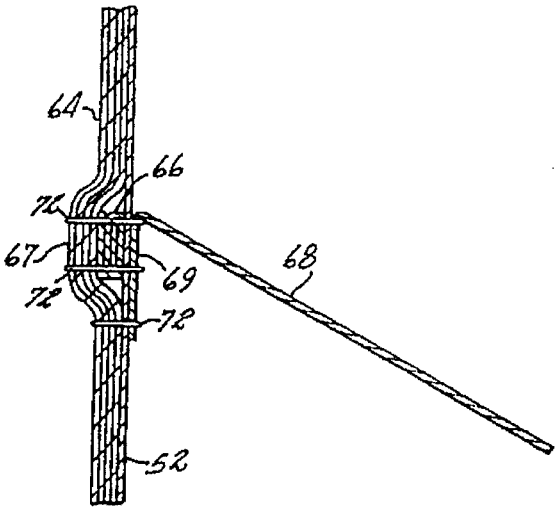
FIG. 10C is a cross-section taken along the line 10C—10C of FIG. 10A.

FIGS. 10A, 10B and 10C show how the upper rear ends 69 of oblique reinforcing straps 86 are attached to the end door portion 52 of flexible insert 40, preferably at the intersections 67 of vertically extending reinforcing straps 64 and horizontally extending reinforcing straps 66. Note that reinforcing straps 64 and 66 are reversely folded for improved strength and are interconnected by sewing 72. However, the reinforcing straps need not be folded if they are constructed of heavier thicker materials having greater strength, such as that available from automobile seat belts. Further, upper rear ends 69 may be connected to end door portion 52 at any suitable location on end door portion 52.

Figure 3:
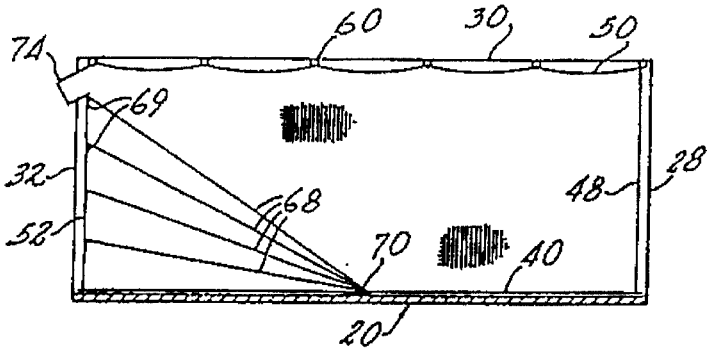
FIG. 3 is a side elevational view of the flexible insert of FIGS. 1 and 2, showing one of several alternate methods of securing a plurality of oblique reinforcing straps, each constructed to extend between lower forward ends attached to a floor portion and upper rearward ends attached to end door portion reinforcements to prevent outward bulging of the end door portion of the flexible insert when the insert is installed within the container and loaded with cargo.
Figure 4:
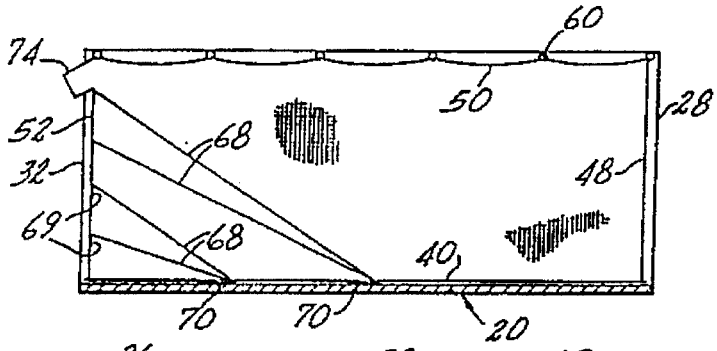
FIG. 4 is a view similar to FIG. 3 of a second embodiment of interior oblique strap arrangements.
Figure 5:
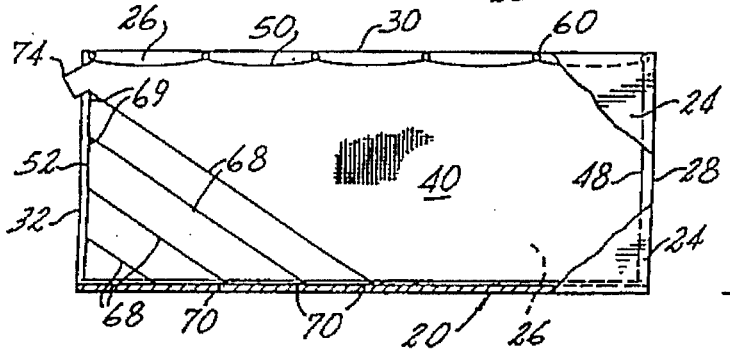
FIG. 5 is a view similar to FIGS. 3 and 4 showing a third embodiment of interior oblique strap arrangements.

Several methods of attaching the lower ends 70 of oblique reinforcing straps 68 to floor portion 42 beneath covering and reinforcing flaps 71 are depicted in FIGS. 3, 4 and 5. Each lower end 70 is reversely folded and attached to floor 22 of the container 20, the lower ends 70 are nailed at 91 or otherwise attached to a wooden floor wall 22 near flaps 71. If floor wall 22 is metal, lower ends 70 may be attached thereto by screwing. The upper ends 69 of oblique reinforcing straps 68 are preferably attached by sewing upper end 69 at the intersections 67 of vertically extending reinforcing straps 64 and horizontally extending reinforcing straps 66 to form a checkerboard arrangement of end door sub-portions 53. An observation flap 73 may be provided on optional flap 51 or at any convenient location on end door portion 52 to provide access for the visual inspection, sampling or removal of contents. One or more loading and exhaust pipes 74 may be provided to remove exhaust air and fumes, etc. when cargo is introduced.

Figure 2:
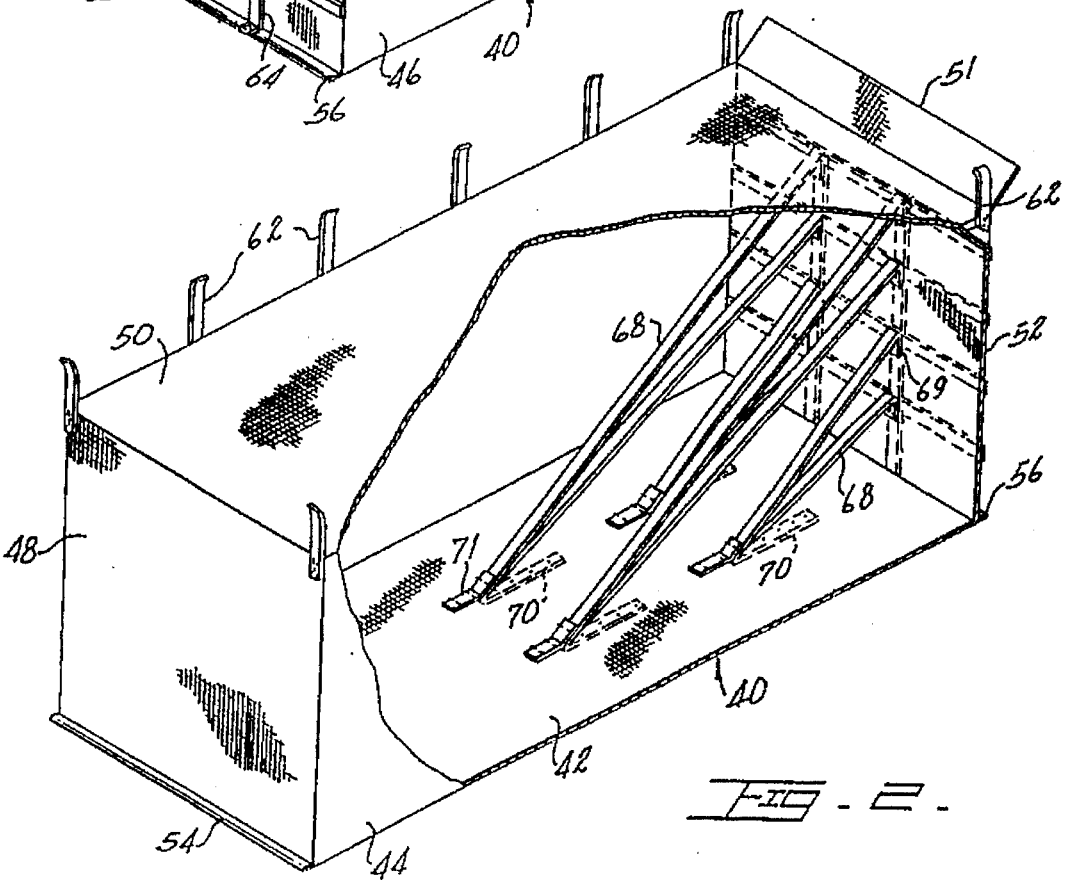
FIG. 2 is a partially cut-out isometric view from the front of a front end portion of a flexible insert of liner open to show some of the inside strap reinforcement arrangements.

The oblique reinforcing straps 68 are composed of plastic material of low stretchability, about ⅛ to ¼ inch thick and 3 to 4 inches wide, for example, and may be attached at transversely spaced locations at their lower ends along a single transversely extending area of attachment only and extend upwardly to different tiers of intersections 67 of horizontally extending reinforcing straps 66 with vertically extending reinforcing straps 64 as shown in FIGS. 1, 2 and 3. Alternately, the lower ends 70 of oblique reinforcing straps 68 may be attached to floor wall 22 along different intermediate areas at longitudinally offset locations as depicted in alternate embodiments in FIGS. 4 and 5. Random arrangements for the attachment areas of lower ends 70 to floor wall 22 may also be made. Metal chains may replace oblique reinforcing straps 68.

Figure 12A:
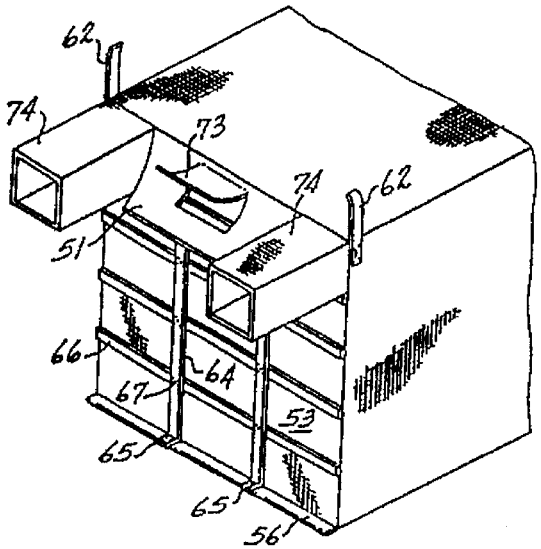
FIG. 12A is an isometric view looking at the outside of the end door portion of the insert modified by a flapped end sub-portion flanked by a pair of loading and exhaust pipes.
Figure 12B:
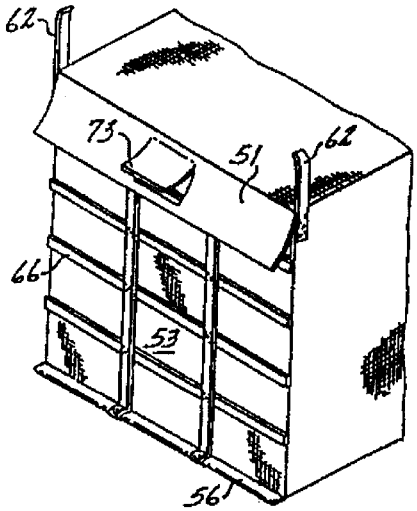
FIG. 12B is a view similar to FIG. 12A showing an alternate construction of the upper flap portion with a local flap as in FIG. 12A but omitting the loading and exhaust pipes.

Optional upper flap portion 51 may be provided with an observation flap 73 as shown in FIGS. 12A and 12B. Loading and exhaust pipes 74 may extend completely across the width of the end door portion 52 as in FIG. 12C or may flank opposite sides of an optional upper flap portion 51 as depicted in FIG. 12A. An additional optional flap 151 may be provided as shown in FIG. 13 in case of large loads where additional support is needed to hold a larger cargo. A probe, not shown, may be inserted into any end door sub-portion 53 desired to sample the cargo. Supplemental straps 89 (FIG. 12C) are used to secure exhaust pipe 74 in a closed condition, preferably by sewing or typing. Supplemental straps 89 may also be used in FIG. 12A if desired, even though omitted from the drawing.

A typical technique for installing a flexible insert 40 within a container 20 is depicted in FIGS. 7A through 7D. Initially, flexible insert 40 is inserted in folded flat condition with its floor portion 42 disposed over the floor wall 22 of container 20, exposing only optional front flap portion 54 or its front end adjacent end wall 28. Optional rear flap portion 56, initially folded to expose only forward flap portion 54, is unfolded to expose an intermediate area containing lower forward ends 70 for nailing or screwing to floor wall 22. Since container doors (not shown) are open, it is possible to enter container 20 to nail optional front flap portion 54 to the front end of floor wall 22, nail forward ends 70 to one or more intermediate parts of container floor wall 22, unfold insert 40 further to the rear, and lift the innermost top straps 62 adjacent the front corners adjacent closed end wall 28 of container 20 to loop through corresponding innermost top cargo rings 60 and secure the front of optional roof portion 50 to the front of optional roof wall 30.

If it is desired to have the insert reusable, it is suggested that a buckle 63 be used to tighten the strap 62 so as to lift the optional roof portion 50 of flexible insert 40 upward toward the top cargo rings 60 at the front upper corners of the container 20.

Before the securement is made at the upper top corners, the optional front flap portion 54 or the front end of flexible insert 40 is nailed to the floor 22 adjacent closed front end wall 28. Then going from right to left, as appears in FIGS. 7B, 7C and 7D, the flexible insert 40 is lifted with additional top straps 62 from right to left being attached securely to corresponding cargo rings 60 until a portion of the length of the optional roof portion 50 and side portions 24 and 26 are suspended.

Insert 40 has been prefabricated with flaps 71 covering slots through which lower ends 70 extend to prevent loss of cargo from insert 40. As the latter is unfolded within the container 20 and smoothed, lower ends 70 folded rearwardly from floor portion slots are exposed to be nailed or screwed to floor wall 22. Lower ends 70 of oblique straps 68 are attached to floor wall 22 of container 20 after the forward part of floor portion 42 is smoothed to make it unwrinkled. Optional longitudinal reinforcements 57, if present, are also attached to floor wall 22 from front to rear. Flaps 71 are pre-sewn to floor portion 42 to close the slots through which lower ends 70 extend. Also, optional roof portion 40 and/or side wall portions 44 and 46 are suspended at spaced suspension points provided by the spaced connections of the remaining top straps 62 to corresponding spaced top cargo rings 60 along the length of the optional roof wall 30 and/or the upper edges of side walls 24 and 26.

After the flexible insert 40 becomes fully unfolded, optional rear flap portion 56 or the rear end of floor portion 42 is nailed to the rear of floor wall 22. Now, insert 40 is suspended at its optional roof portion 50 and side portions 44 and 46 by the connections between top straps 62 and top cargo rings 60 and the attachment of optional front flap portion 54, lower ends 70, and optional rear flap portion 56 and/or optional longitudinal reinforcements 57 of flexible insert 40 to floor wall 22 of container 20. Thus, the insert 40 obtains the shape depicted in FIG. 7D. Obliquely extending reinforcing straps 68 when taut increase the resistance of end door portion 52 to deform in response to outward pressure of a cargo thereagainst.

Optional upper end flap portion 51 is lifted and material to be shipped is inserted through spaces covered by optional flap portion 51 flanked by exhaust pips 74 to load insert 40 with material to be shipped. Pipes 74 are of sufficiently large cross-section to leave room for exhausting air when insert 40 is loaded rapidly.

Figure 14:
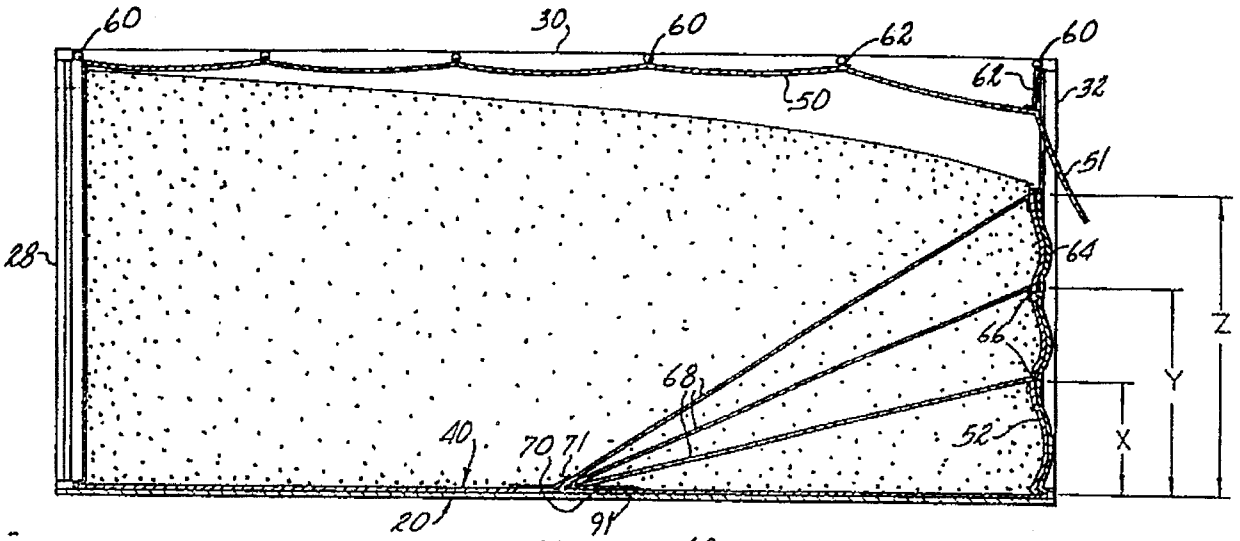
FIG. 14 is an elevational schematic view showing how the end door portions of the flexible insert are arranged for a relatively small load.

Inner closed end portion 48 is lifted by tightening top straps 62 at the inner end of the insert 40 for the container 20 to a level depicted in FIG. 14 where the heights X, Y and Z of horizontally extending reinforcing straps 66 of the end door sub-portions 53 are sufficient to enable flexible end portion 52 to maintain a predetermined normal load inserted into the flexible insert 40 forward of door wall 32 without bulging. Optional flap 51 or, if flap 51 is missing, the upper end of flexible end door portion 52 is then closed and sewn if necessary, and pipes 74 are rolled and tied up when loading is completed to insure that the load of granular material is maintained within the flexible insert 40 for container 20 during transport of the load from the loading station to the unloading station.

Figure 15:
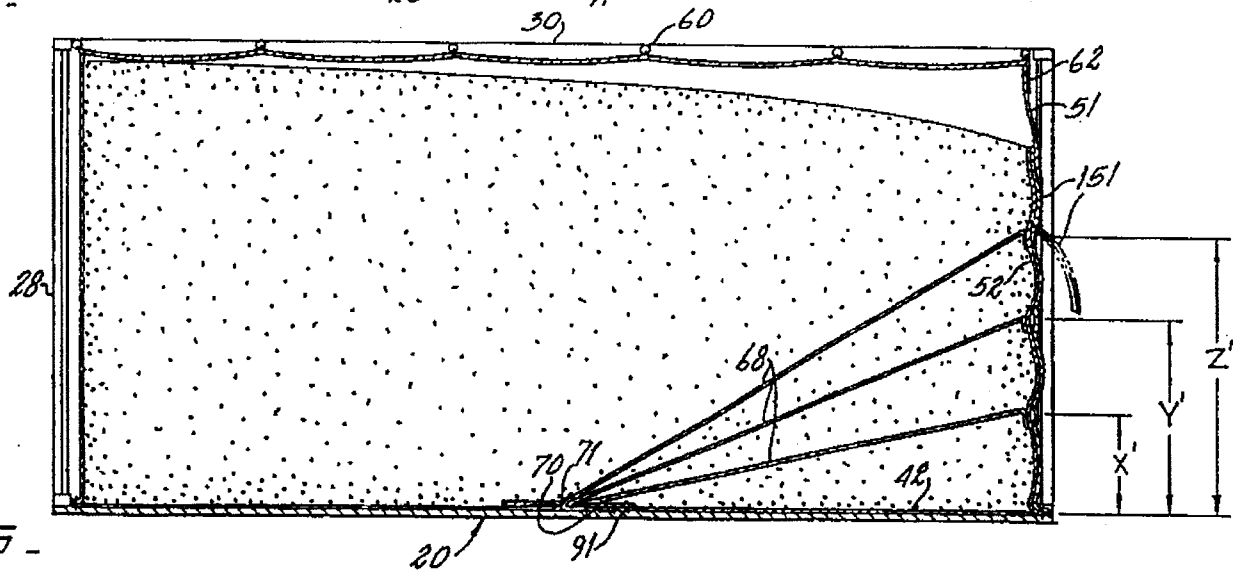
FIG. 15 is a view similar to FIG. 14 showing how the end door portion of the flexible insert is arranged with the supplemental flap portion of FIG. 13 when a larger load than that of FIG. 14 is loaded into the container.

If the load within container 20 is larger than depicted in FIG. 14, as shown in FIG. 15, then an auxiliary optional flap 151 is provided for end door portion 52 at the right end of the figure and is sewn to the side portions 44 and 46 during or prior to loading to augment the height of the lower three levels or tiers of end door portion 52 above heights equal to X', Y' and Z', respectively and enable auxiliary flap portion 151 below the flap portion 51 to withhold the load above level Z' as depicted in FIGS. 13 and 15. FIG. 15 shows auxiliary flap 151 in phantom hanging does and in full lines supplementing the height of end door portion 52.

If the load to be inserted into container 20 when flexible insert 40 is installed is smaller than the capacity of container 20, upper end flap portion 51 may be omitted and so may the auxiliary flap portion 151. Obliquely extending reinforcing straps 68 are sufficiently strong to prevent end door portion 52 from bulging outward when end door wall 32 of a loaded container 20 is open and end door portion 52 is lifted toward the upper end of container 20. Omitting upper end flap portion 51 leaves an opening above end door wall portion 52 and below optional roof wall 30 through which air may escape when insert 40 is loaded.

Optional roof wall 30 may be apertured and provided with a downwardly extending sleeve (not shown) to enable container 20 to be loaded through said roof. Under such circumstances, roof portion 50 may be partially or entirely omitted or provided with one or more apertures 49 (FIG. 21) constructed and arranged for alignment with each roof aperture (not shown). Straps 62 attached side portions 44 and 46 to corresponding cargo rings 60 along side walls 24 and 26.

Figure 16A:
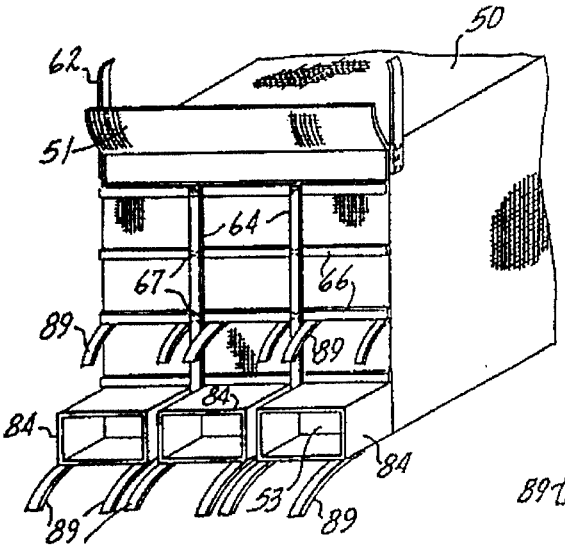
FIGS. 16A, 16B, 16C and 16D are isometric end views of the door portion of the flexible insert while unloading a cargo, FIG. 16A showing the use of three shooters, FIG. 16B showing an enlarged shooter, FIG. 16C showing an alternate construction of an unloading shooter and FIG. 16D showing an end arrangement without a shooter at the bottom, and also including an alternate structure in which a selected oblique reinforcing strap is secured at one end to a selected cargo ring.
Figure 16B:
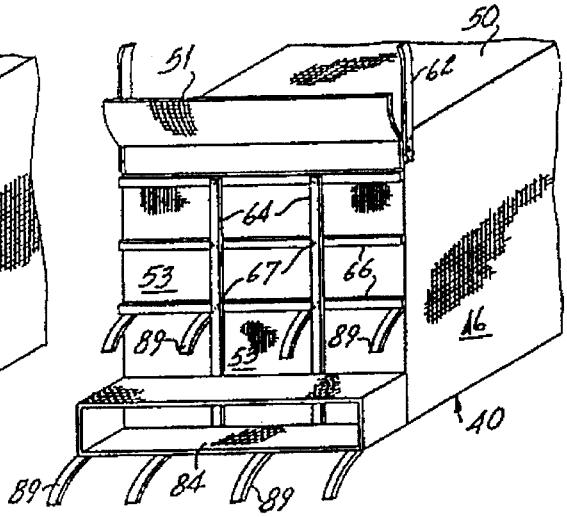
Figure 16C:
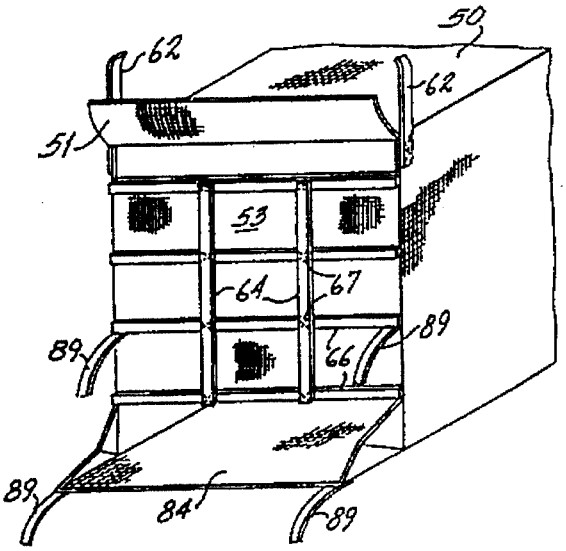

It is possible to use shooters 84 as a means for unloading the contents from within the flexible insert 40 without causing a load to be emptied at such a severe rate that it presents a danger to unloading personnel. Various alternative arrangements for unloading devices or shooters may be provided such as depicted in FIGS. 16A, 16B and 16C. Also, it is understood that shooters 84 may be shaped in cross-section to conform to the rectangular or other shape of the end door sub-portions 53. Shooters 84 may be opened according to a desired program as the flexible insert 40 is unloaded. By programming the successive positions where access openings for the sub-portions 53 are opened, dangerous accidents are avoided.

The drawings show different variations of this invention. For example, in FIGS. 3, 6 and 7D, all the oblique reinforcing straps 68 are attached at their lower, forward end 70 along a common transverse area of attachment and extend upwardly and rearwardly to their upward and rearward ends 69 attached to the intersections 67 of different vertically extending reinforcing straps 64 and horizontally extending reinforcing straps 66 at different tiers so that oblique reinforcing straps 68 radiate upward to taut condition in different directions from a common transverse area of attachment when flexible end door portion 52 is lifted to enable end door portion 52 to retain a cargo of liquid or pulverulent material within insert 40. In FIG. 4, as in FIGS. 1 and 2, two sets of oblique reinforcing straps 68 are provided, with the lower, forward ends 70 of some of oblique straps 68 attached to floor wall 22 along a first intermediate area of connection to extend upward an rearward to the upper intersections 67 while the remaining oblique straps 68 are attached to a second part of floor wall 22 along a second intermediate area of connection to radiate upward and rearward to lower intersections 67. In FIG. 5, the oblique straps 68 are arranged in a different set of transversely spaced oblique straps attached at their lower forward ends 70 to different transverse areas of connection along the length of floor wall 22. The forwardmost ends 70 of oblique straps 68 interconnect floor wall 22 along a forwardmost transverse area of connection with the intersections 67 of vertically extending reinforcing straps 64 and horizontally extending reinforcing straps 66 along the uppermost tier of sub-portions 53. In this latter embodiment, successive sets of oblique straps 68 have their lower, forward ends 70 attached to successive transverse areas of connection spaced rearwardly of one another and extending upwardly and rearwardly to intersections 67 located along successive tiers, each lower than the previous attached tier, to develop the arrangement shown in FIG. 5. In another alternative attachment arrangement, forward ends 70 are attached to floor wall 22 in a random arrangement of attachment areas.

Figure 12C:
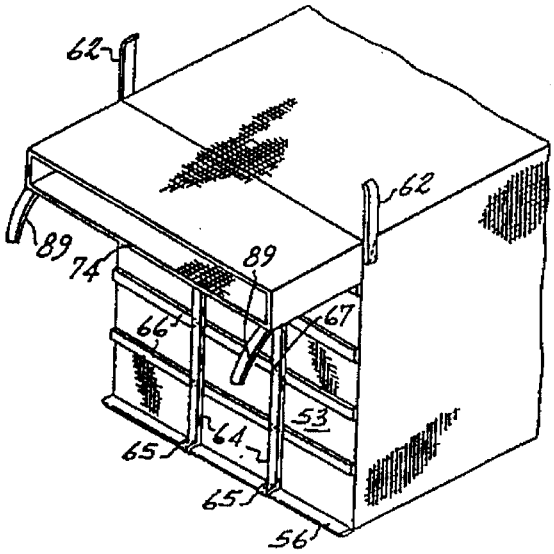
FIG. 12C is a view similar to that of FIGS. 12A and 12B showing an alternate embodiment of end door portion for the insert having a single loading and exhaust pipe extending across the entire width of an upper tier of end door sub-portions.
Figure 13:
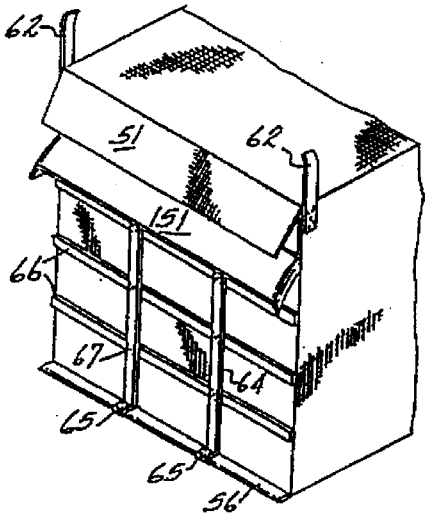
FIG. 13 is a view similar to those of FIGS. 12A, 12B and 12C showing still another embodiment of an end door portion that comprises an optional supplemental flap portion.

Referring to FIGS. 12A, 12B, 12C and FIG. 13, various arrangements of local observation flaps 73 and exhaust pipes 74 are shown. Each of the end door sub-portions 53 may be provided with local flaps 73 as needed for inspection or with exhaust/feeder pipes 74 for loading, sampling and unloading. FIG. 12A shows an upper end flap portion 52 flanked by a pair of feeder pipes 74 to close an opening above the highest tier of sub-portions 53. In FIG. 12B, upper end flap portion 51 extends completely across the opening above the tiers of end door sub-portions 53. In FIG. 12C, an exhaust/feeder pipe 74 extends across the entire opening above the tiers.

In FIG. 13, an auxiliary flap portion 151 is located below upper end flap portion 51 to increase the effective height of the tiers of end door sub-portions 53. Auxiliary flap portion 151 may also replace upper end flap portion 51 and may be foldedly attached to the upper end of end door portion 52 and assume the position occupied by end flap portion 51 when auxiliary flap portion 151 is unfolded and secured by attachment straps (not shown) to cargo rings 60 or additional attachment straps (not shown) fixed across the optional roof wall 30 or the upper end of door wall 32 at the rear end of container 20.

Figure 16D:
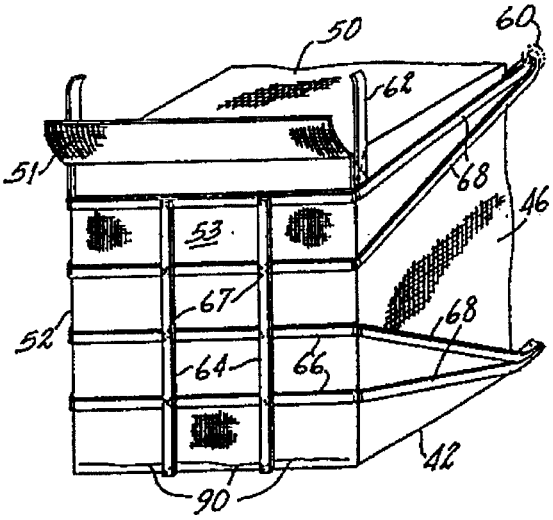

Shooters 84 may be provided for unloading wherever desired in door wall portion 52. FIG. 16A shows a series of horizontally aligned shooters 84 replacing sub-portions 53 along the lowest tier of sub-portions 53. In FIG. 16B, a shooter 84 extends the entire length of the lowest tier. The shape of the shooters 84 is rectangular in the previous figures. In FIG. 16C, shooter 84 is constructed with a floor and sidewalls, but no roof. In FIG. 16D, door wall portion 52 is not provided with a shooter and unloading may be accomplished by slitting door wall portion 52, such as shown by reference number 90. A flap portion 51 shown in FIGS. 16A–16D does not have an inner inspection flap 73, but may be so provided. In other words, the design of exit door portion 52 is flexible depending on the demands for loading, inspecting and/or unloading. Shooters 84 can be closed by rolling and tying or sewing supplemental straps 89 (see FIGS. 16A, 16B and 16C) until it is necessary to unload the cargo.

Oblique interior reinforcing straps 68 are shown in FIGS. 1 and 2 with lower forward end 70 attached to floor wall 22 and upper rear ends 69 attached to reinforcing straps 64 and 66 at their intersections 67. However, oblique reinforcing straps 68 may be attached to or extend from any reinforcing strap 64 or 66 in spaced relation to intersections 67 and may extend in an oblique forward direction either downward toward floor wall 22 or upward to convenient top cargo ring 60 attached to either side wall 24 or 26 or closed front end wall 28 or optional roof wall 30.

FIG. 16D shows an embodiment wherein an oblique reinforcing strap 68 extends forward along side portion 46 from an end of a horizontally extending reinforcing strap 66 obliquely upwardly to an upward and forward attachment to a suitable top cargo ring 60 shown in phantom. A similar connection may be made along side portion 44. FIG. 16D also shows oblique reinforcing straps 68 attached at their upper rear ends to relatively low horizontally extending reinforcing straps 66 of end door portion 52 and at lower forward ends to a container floor wall 22 on which insert floor portion 42 rests in the manner of FIG. 1.

The reinforcements provided by attaching certain oblique reinforcing straps to cargo rings supplement the reinforcement obtained from oblique reinforcing straps connected to the container floor wall. The additional oblique reinforcement straps 68 of FIG. 16D are directly attached to side wall portions 44 and 46 along either their inner or outer surfaces to further reinforce and side wall portions against outward bulging.

The optional roof wall 30 may be apertured and the insert constructed and arranged with an optional roof portion 60 open at 49 (FIG. 21) in alignment with the apertured portion of optional roof wall to permit entry of cargo into said insert via aligned apertured portions of roof wall 30 and in roof portion 50 with removal of air from the insert above its end door wall portion 52. Loading insert 40 straightens the obliquely extending reinforcing straps and reinforces exit door portion 52 against outward bulging. Final closing of end door portion 52 is accomplished by attaching end door portion straps to corresponding cargo rings attached across the rear end of the optional container roof 30 and/or the upper, rear ends of container side walls 24 and 26.

It is also possible to eliminate a closing flap portion 51 extending rearward and downward from the optional roof portion of the insert. When the cargo loaded into the insert is less than a full load, no closing flap portion extending rearward and downward from the roof portion need be present. It is also possible to support a full load of cargo within the insert by attaching an auxiliary flap portion 151 to the upper end of the reinforced end door portion 52 as a substitute for the end flap portion 51 that overlaps end door portion 52 in the first embodiment described. The resulting structure would be similar to that of FIG. 13, except that optional flap portion 51 is omitted and auxiliary flap portion 151 extends upward from the upper end of end door portion 52 to approximately the rear end of optional roof portion 50 but has straps 62 at the upper end of auxiliary flap portion 151 constructed and arranged to engage cargo rings 60 or additional straps 62 across the rear end of optional roof wall 30 to close the opening below optional roof portion 50 without any other direct connection between auxiliary flap portion 151 and roof portion 50.

FIG. 17A shows an embodiment of this invention in which insert 40 has a single flexible end door portion 52 and other wall portions are missing. In this embodiment, a transverse reinforcement 55 is fixed to the bottom of flexible end door portion 52, which also contains upwardly extending flexible straps 62 that cooperate with cargo rings 60 supported along the upper part of container 20 to suspend end door portion 52 therefrom. Criss-crossing reinforcements 64 and 66 form intersections 67 throughout the area of flexible end door portion 52 to reinforce the latter. Intersections 67 are preferred locations for attaching the rear ends of oblique reinforcing straps 68 to flexible end door portion 52, although any location in portion 52 may be chosen for attaching the rear end 69 of any oblique reinforcing strap 68. The forward ends 70 of oblique reinforcing straps 68 are secured to floor wall 22 of container 20 so that when container 20 is filled, oblique reinforcing straps 68 are taut to prevent outward bulging even in the absence of any other wall portions for flexible insert 40. Thus, straps 62 cooperate with cargo rings 60 to provide suspension means, and nails 91 extending through transverse reinforcement 55 and forward end 70 provide attachment means securing insert 40 in fixed relation to floor wall 22 of container 20. It is understood that this embodiment is designed especially for use with cargo that can be readily removed from container 20 and that does not harm the latter by storage therewithin.

FIG. 17B shows an embodiment similar to FIG. 17 wherein the end door portion 52 of the FIG. 17A embodiment is attached to a floor wall portion 42 of an unreinforced flexible insert 40 through transverse reinforcement 55 at the rear end of floor portion 42 and through forward ends 70 of flexible obliquely extending reinforcing straps 68 at the intermediate part of floor portion 42. In this embodiment, unreinforced flexible insert 40 has no oblique reinforcement straps 68 and comprises a floor portion 42 as well as end door portion 52 and side wall portions (such as 44 and 46 of earlier embodiments) and an optional roof portion (such as 50 of earlier embodiments). End door portion 52 is interposed between unreinforced flexible insert 40 and container 20. This protects the inner surfaces of the corresponding wall of container 20 from direct contact with a cargo. In this FIG. 17B embodiment, the front part of floor portion 42 of unreinforced flexible insert 40 rests on the front part of floor wall 22 and the rear part of floor portion 42 rests on taut oblique straps 68 and the rear part of floor wall 22, when unreinforced insert 40 contains a cargo. Attachment means 91 that fix the forward ends 70 oblique reinforcing straps and transverse reinforcement 55 to floor portion 42 also inherently attach ends 70 and transverse reinforcement 55 to floor wall 22. In retrospect, the broadest aspects of this invention relates to a flexible insert 40 comprising a flexible end door portion 52 having suspension means extending upward to cooperate with cooperative suspension means fixed to the upper part of the container, a transverse reinforcement 55 for the bottom of said flexible end door portion 52 and obliquely extending reinforcing straps 68 connecting end door portion 52 directly to container 20. The presence of additional wall portions for optional unreinforced flexible insert 40 protects container 20 from damage due to direct exposure to the cargo.

Figure 19:
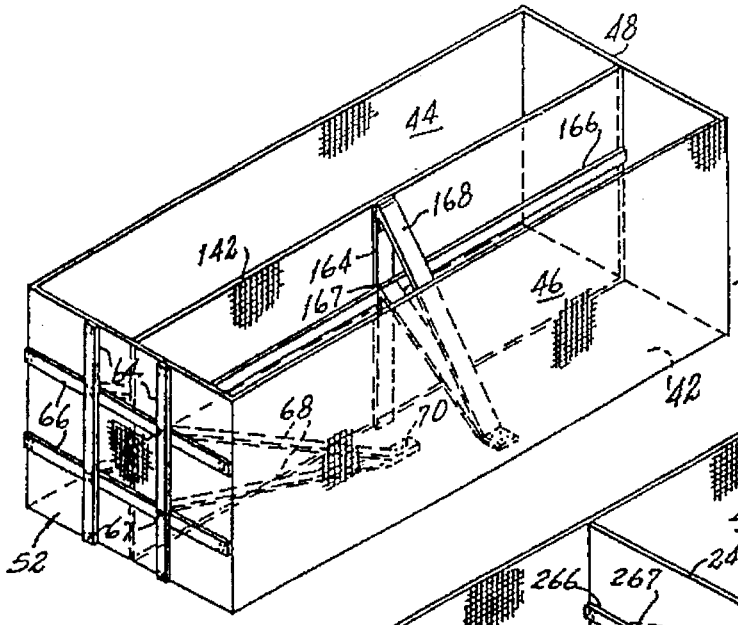
FIG. 19 is an isometric view, similar to that of FIG. 1, of an insert having a flexible longitudinal wall dividing the insert into two longitudinally extending insert compartments.
Figure 20:
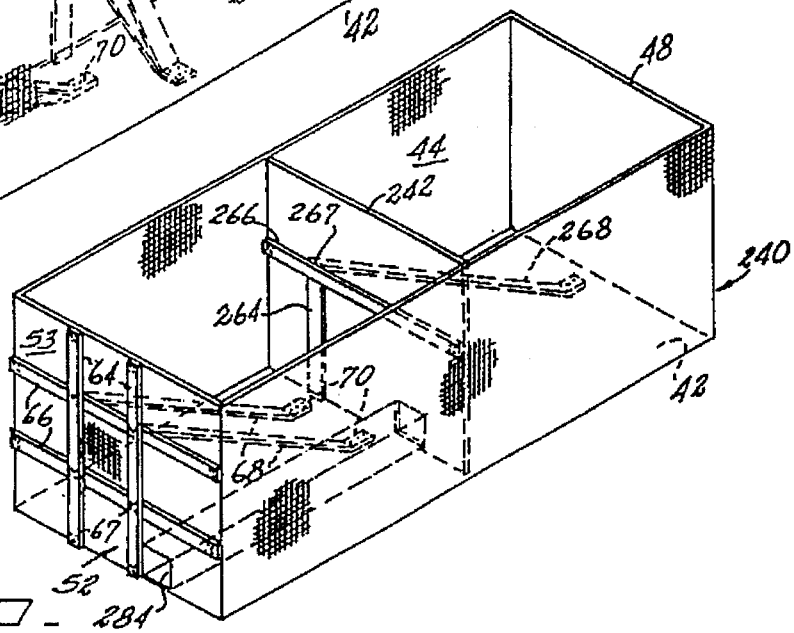
FIG. 20 is an isometric view similar to that of FIG. 18, of an insert having flexible transverse wall dividing the insert into front and rear compartments.

In other embodiments of this invention illustrated in FIGS. 19 and 20, flexible insert is divided into compartments to transmit loads of the same or different material simultaneously. FIG. 19 shows a flexible insert 140 having a floor portion 42, side wall portions 44 and 46, front end portion 48 and an end wall portion 52 corresponding to portions identically numbered in FIGS. 1 and 2 with a roof portion omitted to show an optional interior, longitudinally extending flexible wall portion 142 having crisscrossing reinforcements 164 and 166 forming intersections 167 similar to reinforcements 64 and 66 and intersections 67 on end door portion 52. Only one of many reinforcements 164 and 166 and only one of many intersections 167 are shown in FIG. 19 to simplify illustration. Oblique interior transverse reinforcements 168 similar in structure to oblique internal reinforcements 68 of the earlier embodiment are unfolded to be taut to support longitudinally extending wall portion 142 from bulging transversely outward away from the rest of the compartment containing oblique reinforcements 168. To accomplish this end, oblique reinforcements 168 are connected at a first end to floor portion 42 and at a second end to interior wall portion 142. A first longitudinal compartment containing oblique reinforcements 168 is loaded. Then, with interior wall portion 142 supported against bulging by taut reinforcements 168, the second longitudinal compartment without oblique reinforcements 168 is loaded with another cargo. At its destination, the second compartment is unloaded first while the first compartment is supported in unbulging condition.

In FIG. 20 embodiment is similar to the FIG. 19 embodiment except that the insert 240 of FIG. 20 has a transversely extending flexible wall portion 242 that separates insert 240 into front and rear compartments. Transversely wall portion 242 has crisscrossing reinforcements 264 and 266 forming intersections 267 similar to reinforcements 64 or 164 and 66 or 166 and intersections 67 or 167. Oblique reinforcing straps 268 similar to oblique straps 68 interconnect transverse wall portion 242 to floor portion 42 in the front compartment. A shooter 284 extends from the front compartment through transverse wall portion 242 and the rear compartment to provide an unloading passage through end wall portion 52. Since the front compartment contains oblique reinforcements 268, it is more convenient to first led the front compartment with one cargo, thereby reinforcing transversely wall portion 242 against forward bulging before loading the rear compartment.

It is understood that oblique interior reinforcements 68 connecting end door portions 52 to floor portions 42 are present in the FIG. 19 and FIG. 20 embodiments even though many oblique interior reinforcements 68 are omitted from the drawings and that internal dividing wall portions 142 or 242 have many crisscrossing reinforcements 164 and 166 or 264 and 266 making many intersections 167 and 267 even though many of these structural elements have been omitted from FIGS. 19 and 20 to simplify the drawings. It is also understood that crisscrossing reinforcements 164 and 166 or 264 and 266 may extend in oblique directions as well as horizontally and vertically as depicted without departing from the gist of this invention.

Figure 22:
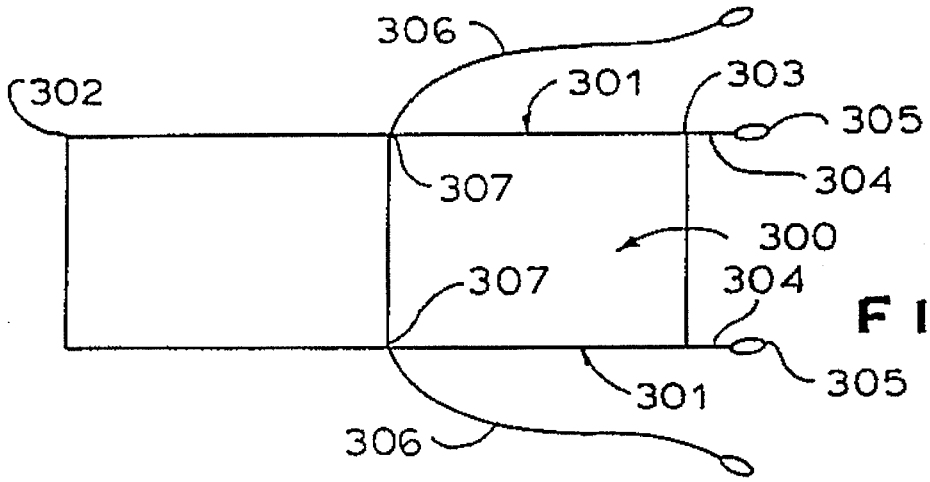
FIG. 22 is a top schematic plan view of an alternate bottom strap arrangement for external support and reinforcement of an insert.
Figure 23:
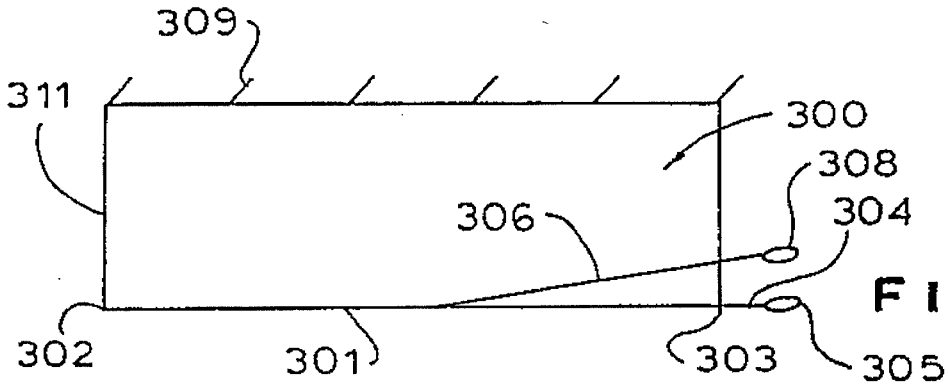
FIG. 23 is a schematic side view of the strap arrangement of FIG. 22.
Figure 24:
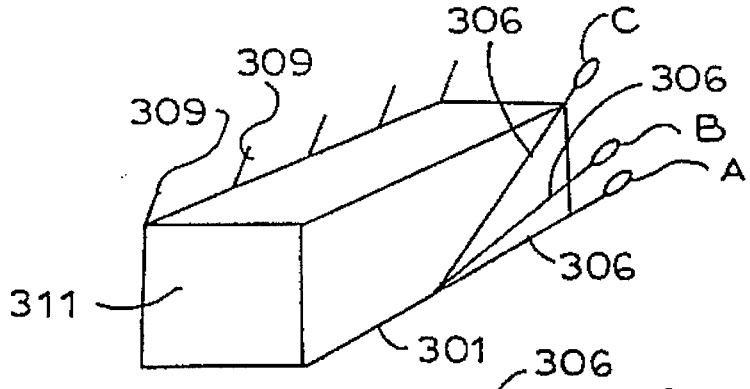
FIG. 24 is a perspective schematic view of the insert of FIGS. 22 and 23.

Referring now to FIGS. 22–24, alternate means of supporting a liner or insert 300 are illustrated. More specifically, at the lower portions of the container a preferably longitudinally extending strap 301 is sewn into the insert and extends from the rear corner 302 preferably to the front corner 303 of the insert or optionally to optional additional strap 306. The bottom corner straps 301 have extensions 304 having optional loops 305 by which the straps 301 are connected directly to the front of the cargo vehicle or container in which the insert 300 is mounted.

The straps 301 may be attached directly to the floor of the trailer or container in which the insert is installed if cargo rings are not available for the optional loops 305 to be attached.

In accordance with the principles of the invention, additional straps 306 which extend longitudinally from the center 307 of the bottom edges of the insert 300 are included for attachment to the vehicle or container in which the insert is mounted. The straps 306 may be attached to the container or cargo vehicle by means of loops 308. Advantageously, strap 306 is attached to the front wall of container in one of the three positions A, B, and C shown in FIG. 24, in which position A the strap 306 is co-linear with the strap 301 and in the position B the strap 306 is at an angle to the strap 301 and in the position C the strap 306 extends past the upper front corner of the insert 300. As an optional strap 306 can be attached to any container side wall or the bottom or top. As will be understood, a series of top straps 309 may be employed to suspend the top of the insert from the container or vehicle in which it is mounted.

Figure 25:
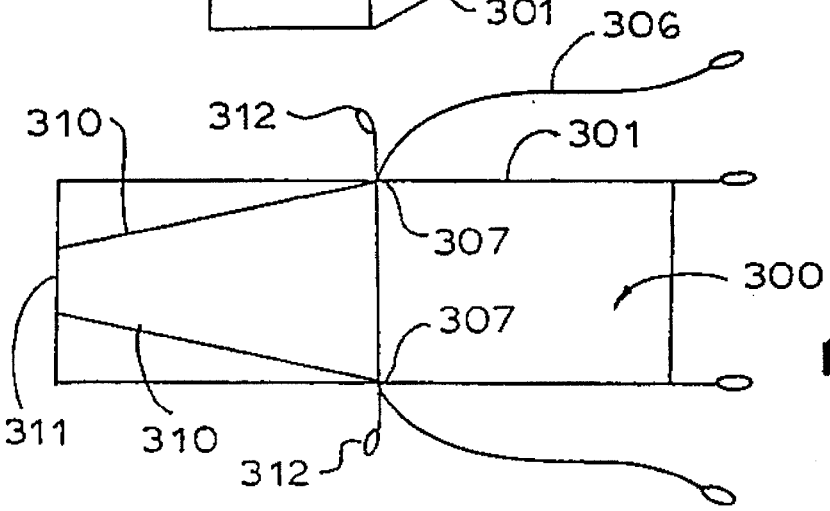
FIG. 25 is a top schematic plan view of the insert of FIGS. 22 and 23 with internal oblique straps arranged at the rear door.
Figure 26:
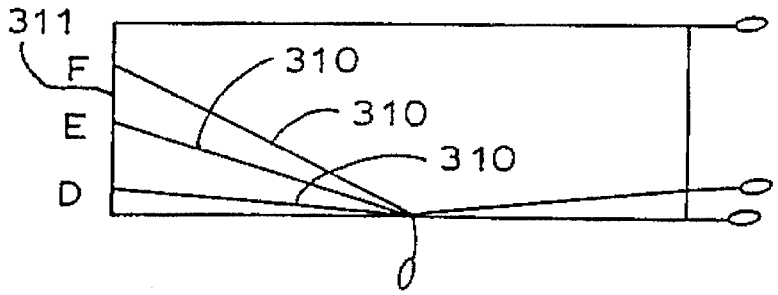
FIG. 26 is a schematic side view of the insert of FIG. 25.
Figure 27:
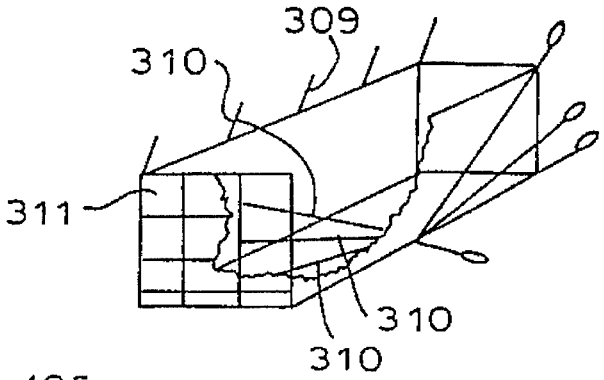
FIG. 27 is a schematic perspective view, with parts of the rear door and side wall broken away, of the insert of FIG. 25 showing the strap arrangement.

As shown in FIG. 25, in addition to the straps 301 and 306 which extend to the front of the vehicle or container in which the insert 300 is mounted, the insert has a series of straps 310 which extend from the rear wall 311 through the midpoint 307 of the bottom side edges of the insert and outwardly through the midpoint terminating in loops 312. The straps 310 may be secured to the container or vehicle by direct attachment by nails or otherwise, or by attaching the loops 312 to appropriate cargo rings. Alternatively, the straps 310 may be sewn or otherwise attached directly to the straps 301 and/or 306 with which they intersect at the center point 307 of the lower edges of the insert 300. Referring to FIGS. 26 and 27, the straps 310 extend obliquely upwardly and inwardly at one or more levels D, E, and F where they are attached to the rear wall 311 as shown.

Where reinforcing straps pass through the insert, it is advantageous to provide a flexible cone of insert fabric at the point the straps transverse the insert wall. The conical structure allows additional freedom and flexibility to the penetrating straps for attachment to cargo rings of the container without wrinkling the insert walls at the point of penetration as might otherwise be the case.

The specific arrangement of straps 301, 306, and 310 illustrated in FIGS. 22–27 securely retains and supports and reinforces the insert within the container of vehicle and specifically retains the container in place when the container or trailer or vehicle in which the insert is mounted is tilted and the pressure of the contained cargo tends to force the bottom and side portions of the insert outwardly towards the walls of the container or vehicle. Moreover the attachment of the straps 301, 306 avoids the need to nail oblique straps to the central bottom portions of the insert. This of course simplifies installation. The rear wall 311, at its lower portions, will be secured to the container by tying or nailing or adding an extra strap 310 at level G.

Optionally straps 310 can be attached to any container cargo ring or cargo vehicle.

Referring now to FIGS. 28–33, a further alternate embodiment of the insert of the present invention is shown in which the insert has a "funnel shape" at the rear end portion. This insert is designed preferably for low density materials and for installation in containers or vehicles over 30 feet in length. The funnel shape allows easier unloading of the bulk materials transported within the insert.

Figure 28:
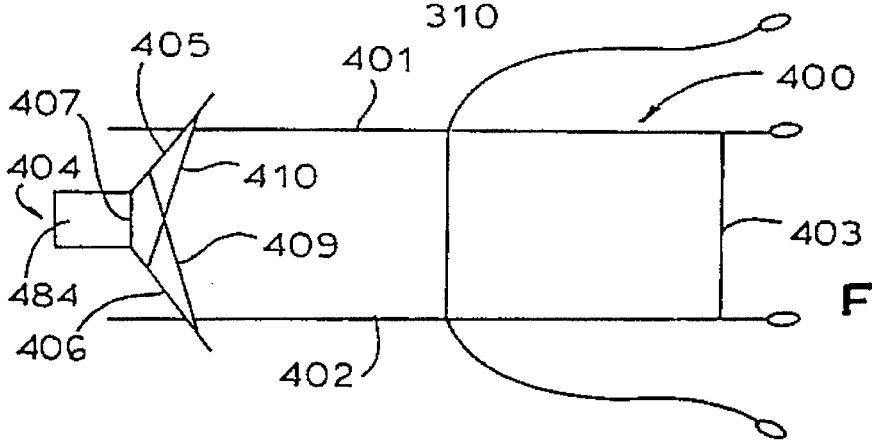
FIG. 28 is a schematic top plan view of an insert for optionally containing low density materials within long container or cargo vehicles optionally in excess of 30 feet and having an optional "funnel-shaped" rear wall configuration.
Figure 29:
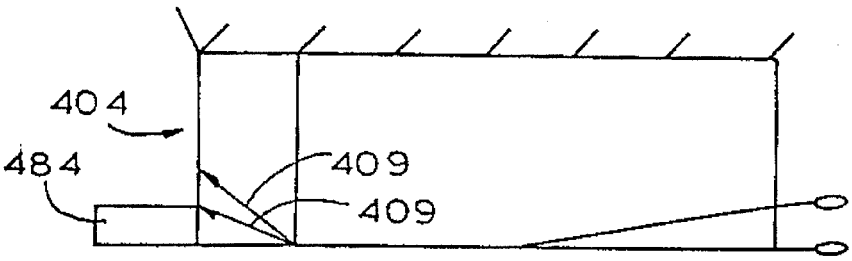
FIG. 29 is a schematic side view of the insert of FIG. 28.
Figure 30:
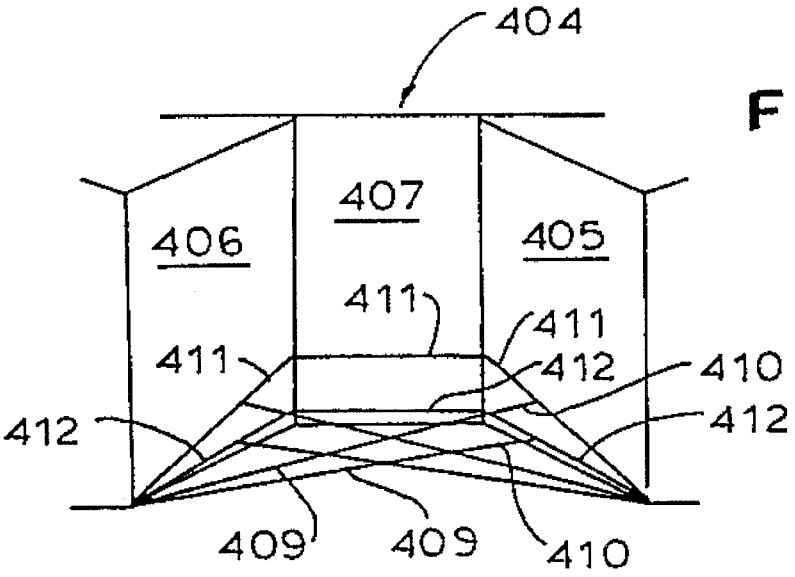
FIG. 30 is a partial schematic perspective internal view of the insert of FIGS. 28 and 29 with an optional shooter in the center of the rear wall.
Figure 31:
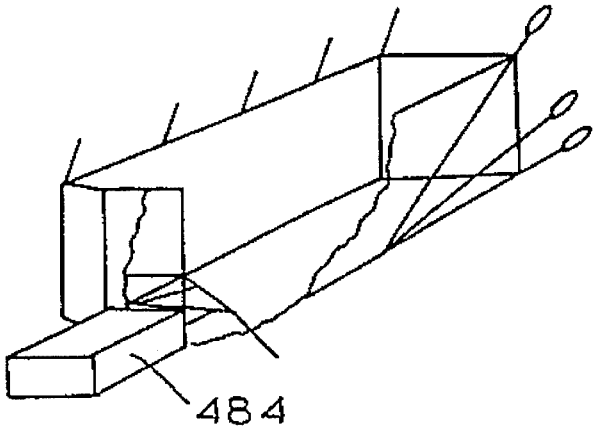
FIG. 31 is a partial schematic external view of the insert of FIGS. 28 and 19.

Referring now to FIG. 28, an insert 400 has parallel side walls 401 and 402, a front wall 403 extending across the full width of the insert and a "funnel shape" rear wall 404 comprised of a pair of angled rear wall portions 405, 406 interconnected at the central portion of the container by a rear wall portion 407 generally parallel to the front wall 403. The insert 400 may be anchored to the container or tailer by straps extending forwardly thereof similar to the strap arrangements shown and described in FIGS. 26 and 27. Similarly to the attachment of the insert shown in FIGS. 26 and 27. Similarly to the attachment of the insert shown in FIGS. 26 and 27, the insert 400 also has top lift straps along the upper portions thereof by which it is connected to the top of the vehicle or the container in which the insert is mounted. The funnel 407 is itself optionally reinforced against outward bulging caused by the contained cargo through the incorporation of a series of reinforcing straps. Particularly as shown in FIGS. 28 and 29, oblique reinforcement straps 409 and 410 extend transversely of the insert between the walls 405 and 406 in a crisscrossing manner. In addition, the optional straps 409, 410 extend upwardly and diagonally across the width of the container as will be appreciated from the schematic representation of FIGS. 30–32.

Further reinforcement is obtained for the funnel shaped rear portion of the insert 400 by optional straps 411 and 412 which extend circumferentially about the funnel rear wall portion 404 which is, of course, comprised of the oblique wall portions 405, 406 interconnected by the central rear wall portion 407. In accordance with principles of the invention, the optional criss-crossing oblique straps 409, 410 are connected to the circumscribing straps 411, 412 as shown, for example in FIG. 30. Unloading of the funnel shaped insert may be facilitated by the employment of a shooter 484 which functions in the manner of the shooters 84 described hereinabove.

Figure 32:
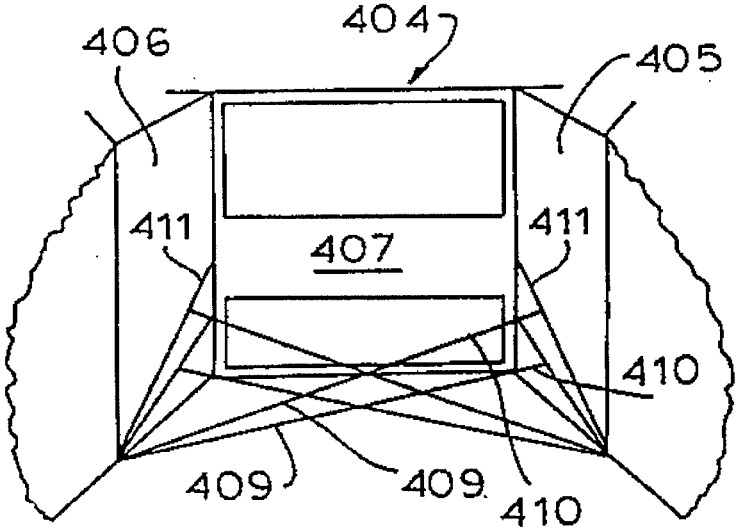
FIG. 32 and 33 are schematic perspective internal views of rear wall strap reinforcements for the insert of FIGS. 28 and 29.
Figure 33:
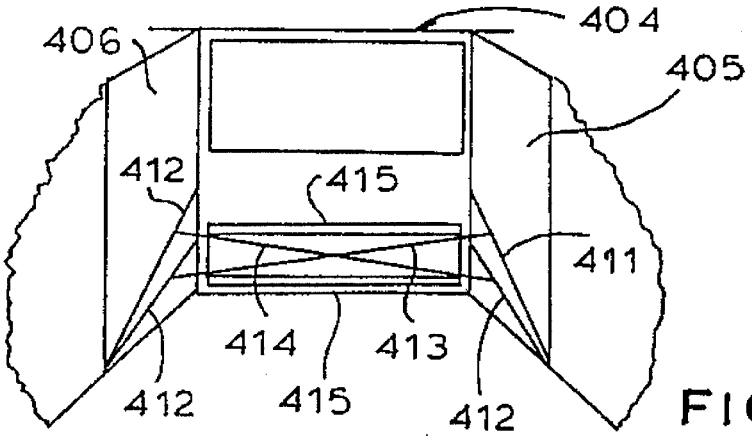

As will be appreciated, specific strap arrangements and means of unloading the central portion 407 of the funnel 404 may be varied within the scope of the present invention. That is to say, as shown in FIG. 32, the optional central reinforcing strap portion of 411 may be eliminated where found advantageous. Moreover, and as shown in FIG. 33, in lieu of the obliquely extending criss-crossing straps 409, 410, optional crisscrossing or parallel straps 413, 414 may be employed, which straps extend transversely across the optional funnel portion 404 between the optional reinforcing straps 411 and 412 on the funnel side walls 405, 406. Alternatively or in conjunction with the criss-crossing straps 413 and 414, parallel transverse reinforcing straps 415 may be employed, which straps extend across the funnel between the reinforcing straps 411, 412 on the tapered sidewalls 406, 405 of the funnel.

Figure 34:
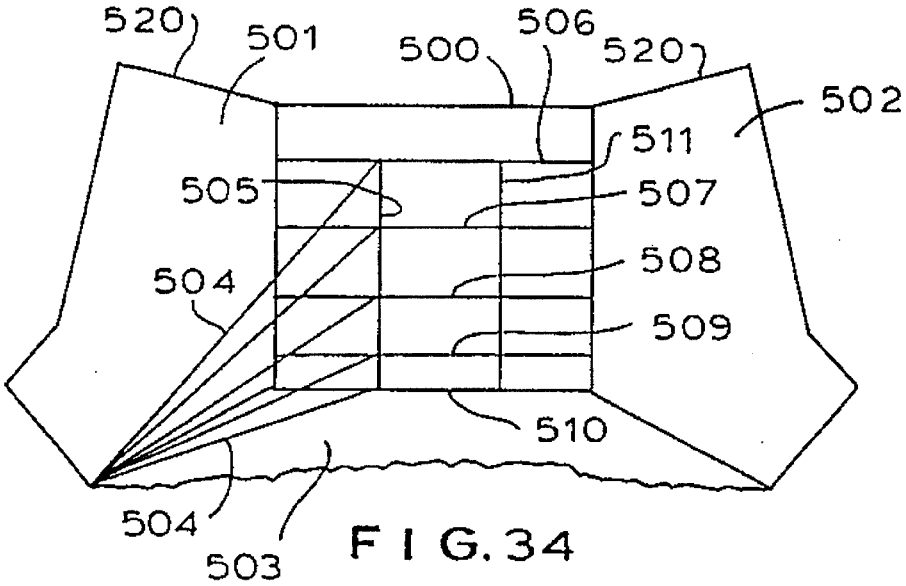
FIG. 34 is a partial schematic perspective internal view of the rear wall reinforcement of the insert of FIG. 28.
Figure 35:
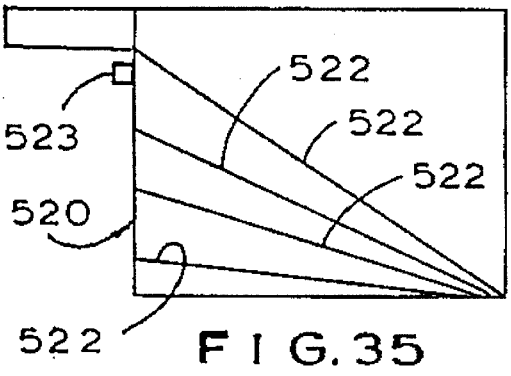
FIG. 35 is a schematic side view showing internal rear wall reinforcement.
Figure 36:
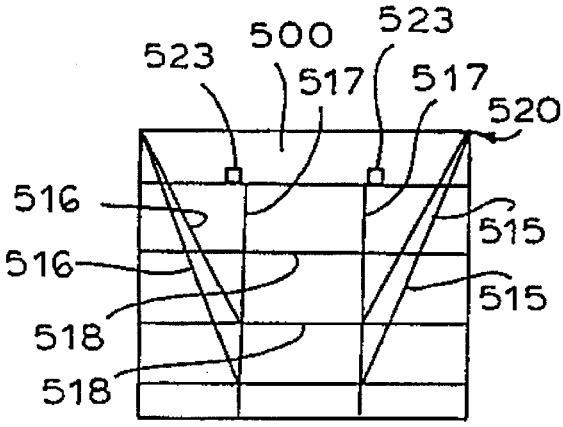
FIG. 36 is a schematic perspective external view of the reinforcing straps of FIG. 35.

Referring now to FIGS. 34, 35, and 36, there is a schematic illustration of reinforcement provided for the rear door portion when the rear door portion of the insert is recessed from the outermost rearmost portions of the container or trailer or other vehicle in which the insert is mounted. This strap reinforcing arrangement is to be contrasted with the internal oblique strap reinforcement in which the reinforcing straps are disposed within the insert itself. However, in the arrangement shown in FIGS. 34–36, the reinforcing straps are disposed externally of the insert and extend from the container or the vehicle to the rear wall portion.

More specifically, a rear wall insert portion 500 is shown disposed within a trailer or a container having sidewalls 501, 502 and a bottom wall 503 which extends for the full width of the trailer or the container between the side walls 501, 502. In this arrangement, oblique straps 504 extend from a point on the side wall 501 forwardly to a vertical reinforcing strap 505 disposed on the rear wall 500. The straps 504 extend inwardly and upwardly as shown to connect with the wall 500 at various heights thereof along horizontal reinforcing straps 506, 507, 508, and 509 as shown. In addition, the lowermost strap 504 is connected to a reinforcing strap 510 which extends along the bottom of the insert as shown. It will be appreciated, although not shown in FIG. 34, that similar straps 504 extend from the wall 502 to the rear wall portion 500 and are connected to vertical strap 511 as will be understood. Additional support reinforcement against bulging of the rear wall 500 may be obtained by reinforcement and further support of the rear wall 500 is obtained from straps 515 and 516 which extend obliquely from the container roof 20 or container cargo rings which, as will be understood, extends across the container side walls 502, 501 to form a top of the container and which roof 520 is in a parallel plane to the container bottom wall 503. Straps 515 and 516 extend from portions of the roof 520 which are disposed rearwardly of the door portion 500. More specifically, as shown in FIG. 36, the straps 515 and 516 extend downwardly from the roof 520 and forwardly of the container until they intersect with the rear door portion 500 along the intersections of optional vertical and horizontal reinforcing straps 517 and 518 as will be understood. As shown in FIG. 35, the rearwardmost portion of the insert of the invention may be obliquely extending straps 522 sewn directly thereto to reinforce them. Moreover, cargo rings 523 may be disposed towards the uppermost portion of the wall 500 for support of the insert from the container or vehicle in which it is mounted when the insert may be subjected toe excessive loading forces.

Figure 37:
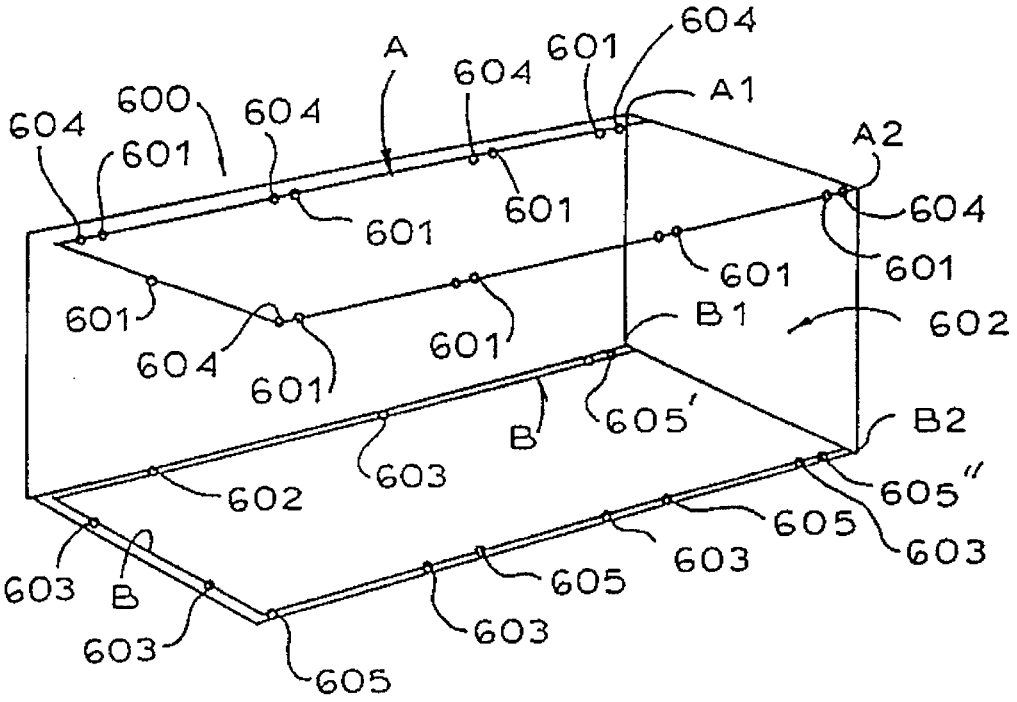
FIG. 37 is a schematic diagram showing an arrangement for supporting an insert within a container in a manner whereby the insert may be simply removed from the container after usage.

Referring now the FIG. 37, an alternate system for attaching the insert to a container or vehicle is disclosed highly schematically. The object of this particular embodiment of the invention is to avoid the necessity for personnel to enter the vehicle or the container to undo the attachments which suspend the insert within the container or trailer or otherwise secure it to the floors, such as by nailing.

While not illustrated in the schematic of FIG. 37, the container insert in which the attachment system 600 is deployed has the six walls of generally rectangular insert such as shown in FIGS. 1 and 2, namely parallel front and rear walls, parallel roof and bottom walls, and parallel side walls all connected to form a generally parallelpiped structure for suspension in a similarly shaped container or vehicle. However, in lieu of the straps 62 shown in FIGS. 1 and 2, and in lieu of the elements 54 and 56 shown in FIGS. 1 and 2, in this embodiment of the invention a series of upper insert rings 601 are attached to the container insert at the upper portions of the side walls and front wall circumscribing the insert at all but the rear wall of the insert which faces the rear wall 602 of the container. Similar lower insert rings 603 are secured about the bottom of the container insert at the lowermost portions thereof along the insert side walls and insert front wall. In accordance with the principles of the invention, upper cargo rings 604 are deployed about the inner walls of the container from the rear, alone the container side walls, along the container front wall, back along the other container side wall to the rear door of the container at the top thereof and similar cargo rings 605 are arranged along the bottom of the container circumscribing the same along the container side walls and the front wall of the container.

In accordance with the principles of the invention, an upper fastening strap A is threaded or otherwise laced through the alternating insert rings 601 and upper cargo rings 604 along the top of the container and the top of the insert. The end A1 of the upper strap A may be secured to the rearmost lower cargo ring 605' while the opposite end A2 will be secured to the opposite rearmost lower container cargo ring 605". Similarly, a lower fastening strap B is threaded through lower insert rings 603 and the lower cargo rings 605 with one end B1 of the lower strap being fastened, tied, or otherwise secured to the rearmost cargo ring 605' on one side of the container and other end B2 of the fastening strap being tied or otherwise fastened or secured to the rearmost lower cargo ring 605".

More specifically, the strap A (it being understood that a rope, chain, or other equivalent of a strap may be employed) is first secured to the rearmost lower vehicle cargo ring 605' and then the strap A is loosely laced or otherwise loosely threaded alternately through the insert rings and the cargo rings until all of the rings have been traversed. Strap A1 is then tightened and attached securely to the rearmost other bottom cargo ring 605" to elevate the insert within the container and to suspend the container insert from the upper cargo rings 601 and 604. It will be understood that in this manner the insert 600 is elevated an installed in the manner of a "Venetian blind" by the system 600.

The bottom of the insert is installed by securing the strap B to the rearmost cargo ring 605' and loosely threading it through the insert rings 603 at the bottom and the cargo rings 605 associated with the bottom of the container. The free end B2 of the bottom strap B may be tightened and secured to the other rearmost lower cargo ring 605" to complete the installation of the insert. It will be appreciated that by tightening the strap B, the bottom portion of the insert will be smoothed out and otherwise unwrinkled prior to the completion of the installation.

Although not shown in picture 37, optional insert rear wall reinforcement straps may be attached preferably to 605 optionally after passing through a cargo ring either 604 or 605.

In accordance with the principles of the invention, an insert installed with the system 600 in a container in this fashion utilizing an upper strap A which circumscribes the roof portion of the insert and is fastened to the rearmost cargo rings and a lower circumscribing strap B which is also attached to the rearmost lower cargo rings, may be reality removed after usage. Removal of the insert is effected by initially untying or sewing rear wall reinforcement straps and then untying or severing the fastening straps A and B and simply pulling them rearwardly of the container to unthread or unlace the attachment of the insert to the upper and lower cargo rings of the insert through the upper and lower insert rings 601 and 603 respectively. Thereafter, removal of the insert may be simply effected by simply grasping the rear wall of the insert and applying a rearward retroactive fore thereto to remove the insert from the container without the necessity of entering the insert or the container.

Figure 38:
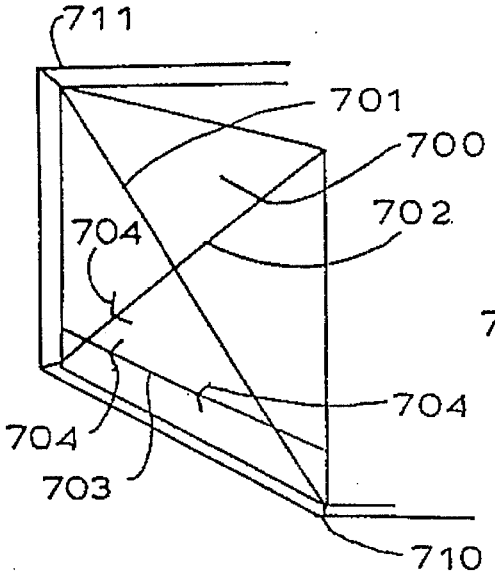
FIG. 38 is a partial schematic perspective of the rear of the insert illustrating an alternative reinforcement thereof and FIG. 39 is a partial schematic perspective of the rear wall of the insert showing an alternate reinforcement thereof.
Figure 39:
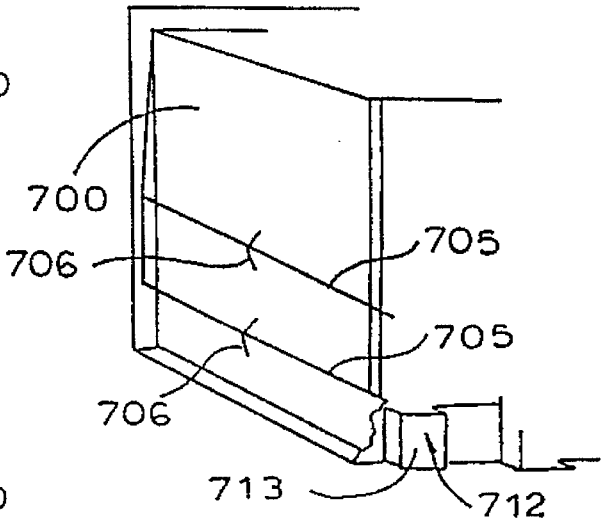

Referring now to FIG. 38 and FIG. 39, alternate means of reinforcing a rear door of an insert are shown in which the reinforcement and support of the insert rear wall is provided by externally disposed reinforcements in lieu of internally disposed oblique straps. For example, diagonal reinforcing straps 701, 702, and/or one or more horizontal straps 703 may engage the outer face of the insert rear wall 700. The free end edges of the straps 701, 702 are fastened by appropriate connecting means such as rings or the like directly to two different inner contain wall 710, 711 proximate to the insert rear wall 700. The rear wall 700 may be provided with insert rings 704 attached thereto, in which case the external support straps 701, 702,703 are threaded through the rings before being secured tightly to the container walls.

One or more straps 703 (sewn or not to insert rear portion wall) attached to different container walls may also be used to avoid outward bulging at insert rear wall portion.

In lieu of the external straps 701–703, rigidifying bars 706 may be deployed in engagement with the insert rear wall 700 to prevent it from bulging when the insert is loaded with cargo. The bars 705 advantageously are mechanically interlocked with the container sidewall 712. When the container is corrugated the bars 705 may be inserted, by appropriate rotation, into corrugations 713 in the wall 712. Further enhancement of the reinforcement my be obtained by attaching insert rings 706 to the rear insert wall 700 to permit the bars 705 to pass through as shown in FIG. 39.

Figure 40:
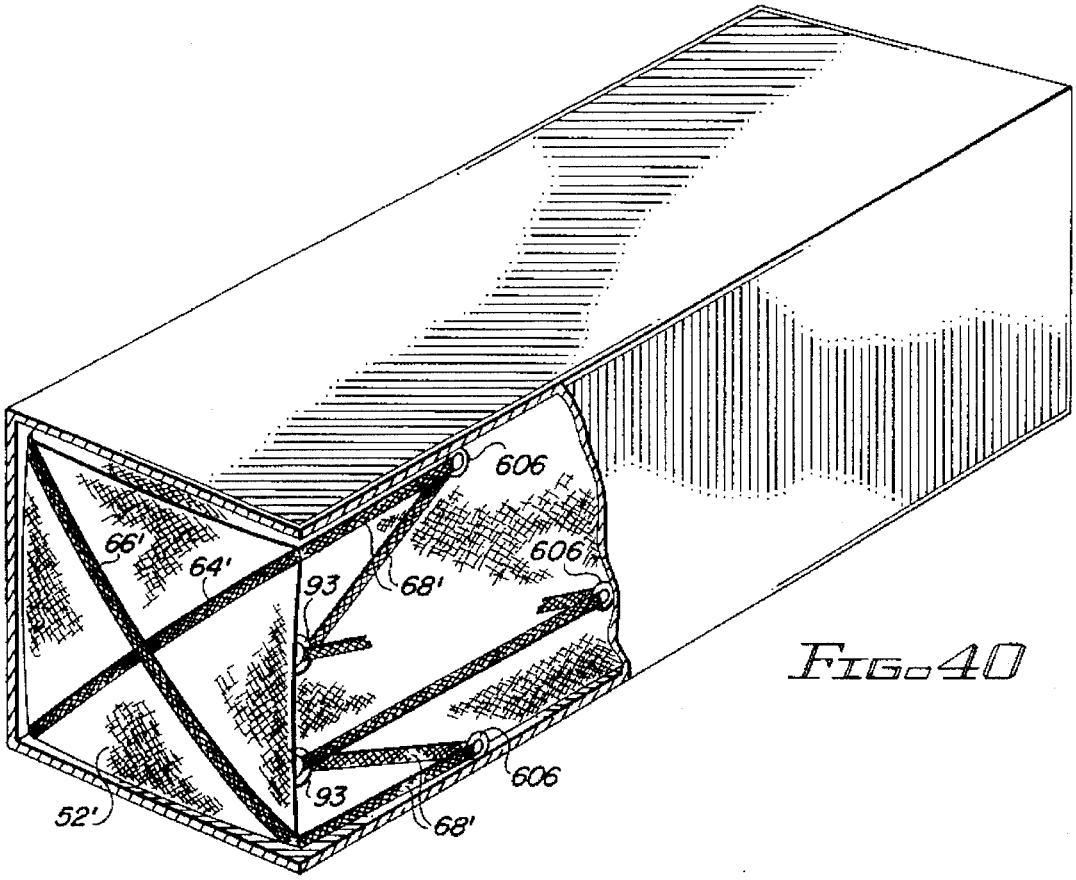
FIG. 40 is a partially cut away, front perspective view of yet another alternate embodiment of the insert of the present invention and illustrating the retention loop on the end door portion of the insert.

Further, the reinforcing straps 64 and 66 may be disposed in any of a variety of patterns along the end door portion 52' so long as it functions to prevent sagging. For example, as illustrated in FIG. 40, the reinforcing straps 64' and 66' may have a diagonal criss-cross, or "X" type configuration. Additionally the portion of the reinforcing straps 68' to be secured to the container may extend along the interior of the insert, as previously recited, or along an exterior of the insert for subsequent securing to a cargo ring 606 on a wall of the container. It is noted that the interior versus exterior disposition is regardless of the configuration of the reinforcing straps 64 and 66 on the rear end door portion 52.

Also, whether the reinforcing straps 68' extend along an interior or exterior of the insert and regardless of the configuration of the reinforcing straps 64 and 66 on the rear end door portion 52, at least one, but preferably a plurality of retention loops 93, as in FIG. 40, may also be included. Preferably the retention loop 93 includes a strap like material loop fixedly secured to the insert, such as along a perimeter reinforcing seam of the end door portion 52'. The retention loop 93 is structured and disposed such that subsequent to the passage of one of the reinforcing straps 68' through a cargo ring 606 in the container, the reinforcing strap 68' may be looped therethrough prior to being tied secure to the insert or the container. As such, a small number of reinforcing straps 68' such as in the case of an "X" type configuration of straps, function to retain the end door portion 52' and prevent it from sagging at a number of locations on the end door portion 52', namely the point where the reinforcing strap extends from the end door portion and the location of the retention loop.

Figure 41:
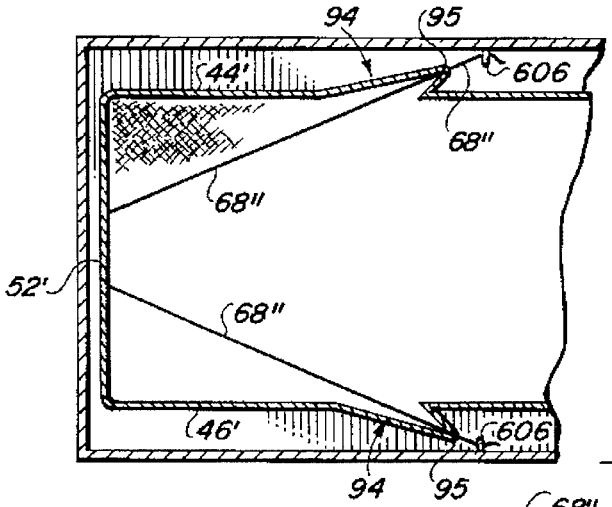
FIG. 41 is a top schematic view the present invention illustrating the adjustable securing port in the insert of the present invention.
Figure 42:
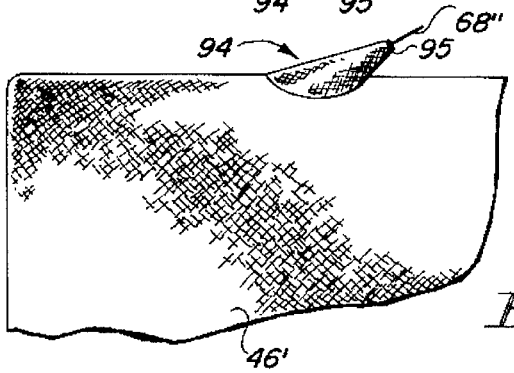
FIG. 42 is an isolated, exterior perspective view of the securing port of the present invention.
Figure 43A:
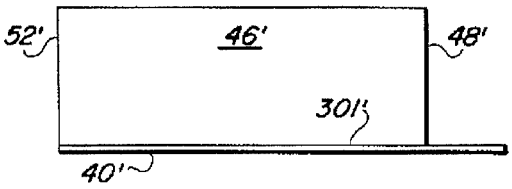
FIG. 43 A–J are partial schematic views of the present invention illustrating alternative embodiments of the longitudinal reinforcing straps.
Figure 43B:
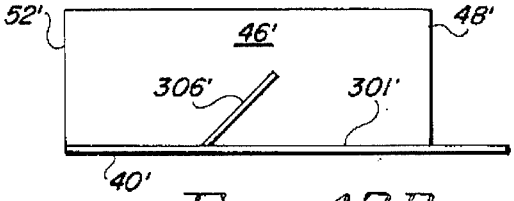
Figure 43C:
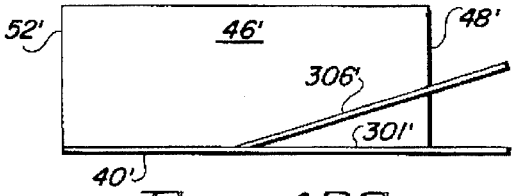
Figure 43D:
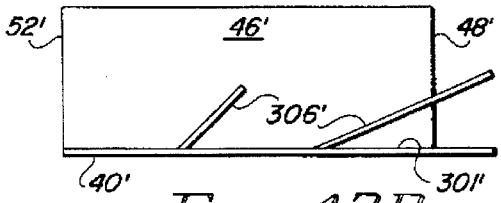
Figure 43E:
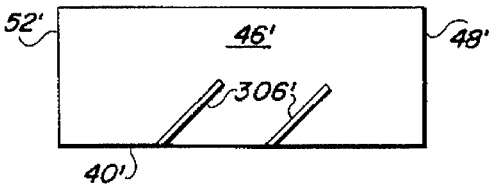
Figure 43F:
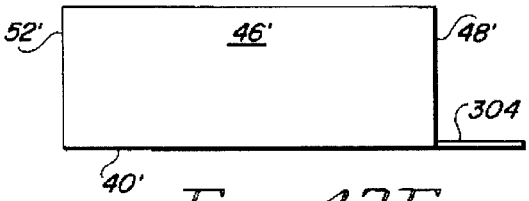
Figure 43G:
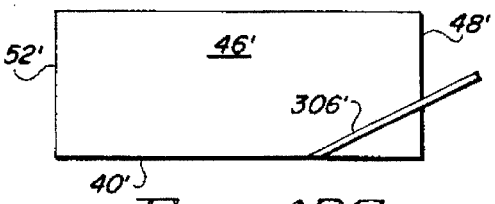
Figure 43H:
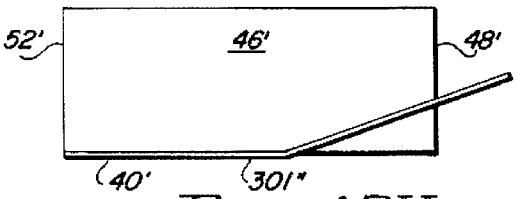
Figure 43I:
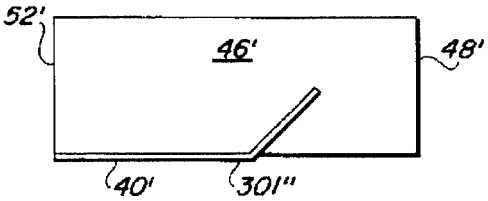
Figure 43J:
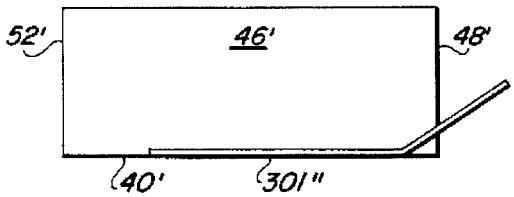

Turning to FIGS. 41 and 42, when the reinforcing straps 68" extend into the insert for subsequent securing, they must generally pass through a surface of the insert. As such, the insert is subject to leaks and/or rips. Further, not all containers uniformly dispose their cargo rings 606, necessitating that the reinforcing straps 68" be capable of being secured to variably positioned rings 606. Accordingly, the present invention includes at least one adjustable securing port 94. The adjustable securing port 94, which is preferably securely sewn into a corresponding portion of the insert, will preferably include a cone shaped configuration that extends preferably outwardly from the portion of the insert to which it is secured such that a point 95 of the adjustable securing port 94 is disposed a spaced distance from the insert. In the preffered embodiment, the point 95 of the port 94 is sewn or otherwise fixedly secured to the reinforcing strap 68" prior to installation of the insert. Alternatively, however, the point may be secured about the strap 68" upon fastening the strap to a cargo ring, such as by an elastic band or a strap. Accordingly, the port 94 will permit a free range of motion for the securing of the reinforcing strap 68" without permitting leaks, as would be the case if a larger opening permitting a range of motion where used, without providing undue stress to the insert upon the reinforcing straps 68" being pulled taut and being strained under the movement of the cargo.

As shown in FIG. 43 A–J, the insert of the present invention will also preferably include at least one longitudinal reinforcing strap 301', which preferably extends beyond the front end portion 48' of the insert, from generally a lower edge of the insert side walls 44' and 46', for securing to the front end wall 28' of the container in order to prevent sliding or sagging of the insert upon the insert being tipped to unload cargo out the rear door opening of the container. In particular with many types of cargo, a front end of the container is elevated during unloading which causes the cargo to slide along the insert, pulling it towards the rear and often rupturing the insert. With the longitudinal reinforcing straps 301' secured in place, the insert will remain properly positioned as the cargo freely slides over the floor portion 40' of the insert. Preferably, the longitudinal reinforcing straps 301' will include a pair of straps that extend along an entire length of the insert along the lower edge of the side wall portions, as in FIG. 43A. Alternatively, however, as illustrated in the remaining figures, and in particular if the liner is strong enough, one or more longitudinal reinforcing straps 301" and 304' which extend along only part of the lower edge of the side wall portions, or which merely extend from the front of the insert, may be included. Further, either individually, with the longitudonal straps 301" and 304' of the previous embodiment, or if desired in combination with the preferred longitudinal reinforcing straps 301', the longitudonal reinforcing straps of the present invention may include one or more obliquely extending longitudinal reinforcing straps 306' which extend from the lower edge of the side wall portions 44' and 46', preferably but not necessarily beyond the front portion 48' of the insert, so as to provide for maximum securing.

Conforming to requirements of the patent statutes, the present invention has been described in terms of a preferred embodiment and various modifications thereof. It is understood, however, that the further modifications may be made in the light of the description that has been made and that the scope of the protection provided is defined by the claimed subject matter that follows.

Now that the invention has been described,

What is claimed is:

1. A flexible insert for installation within a container of generally rectangular configuration having a generally planar floor wall, a pair of generally planar side walls, a generally planar front end wall, and a generally planar closeable rear door wall extending upwardly from said floor wall, said insert comprising:

insert portions constructed and arranged to fit within said container and to be unfolded into a floor portion facing said floor wall and constructed and arranged to be supported on said floor wall, a pair of side wall portions facing said side walls and extending within said side walls, a front end portion facing said front end wall and extending within said front end wall and a rear end door portion facing said rear door wall and extending upwardly from said floor portion within said rear door wall, said insert being constructed and arranged to receive means to secure at least one of said insert portions to a facing container wall to prevent relative movement therebetween, insert suspension means comprising suspension means elements carried by said insert and cooperating suspension means elements carried by said container, said suspension mean elements carried by said insert including a plurality of obliquely extending reinforcing straps, each having a first end secured to said rear end door portion and a second end secured to at least one of said walls of said container that faces one of said other portions of said insert, said obliquely extending straps being constructed and arranged to be taut to support said rear end door portion against bulging outward when said insert is loaded with a cargo of granular material or a liquid stored in said insert.

2. A flexible insert as recited in claim 1 wherein said rear end door portion includes at least one retention loop structured and disposed to receive a free end of at least one of said reinforcing straps therethrough, subsequent to said reinforcing strap being looped through at least one of said cooperating suspension means elements carried by said container, for subsequent securing thereof so as to further support said rear end door portion against bulging outward.

3. A flexible insert as recited in claim 1 wherein said reinforcing straps extend into an interior of said insert for subsequent securing to said at least one of said walls of said container.

4. A flexible insert as recited in claim 3 wherein said portion of said insert which confronts said at least one of said walls of said container to which said reinforcing strap is secured includes at least one adjustable securing port at which said second end of said reinforcing strap is secured to said wall of said container.

5. A flexible insert as recited in claim 4 wherein said adjustable securing port is structured and disposed to facilitate securing of said reinforcing strap to a variably positioned suspension means elements disposed on said wall of said container to which said reinforcing strap is secured.

6. A flexible insert as recited in claim 5 wherein said adjustable securing port includes a generally cone shaped configuration and extends outwardly from said portion of said insert such that a point of said generally cone shaped configuration is spaced from said portion of said insert, thereby providing said point of said adjustable securing port, at which said reinforcing strap is secured to said wall, with a considerable range of motion structured to engage said suspension means element of said container at variable positions along said wall of said container.

7. A flexible insert as recited in claim 1 wherein said insert portions includes a roof portion.

8. A flexible insert for a rigid container having a floor wall, a front end wall, a pair of side walls and a rear door wall extending upward from said floor wall, said flexible insert comprising:

a flexible end door portion that tends to bulge outward when said rear door wall is opened while said container is loaded with a cargo, means attached to said end door portion to resist outward bulging comprising:

suspension members extending from an upper part of said end door portion and constructed and arranged to cooperate with cooperating suspension members carried by an upper part of said container, a bottom part of said end door portion constructed and arranged for connection to a bottom part of said container, and obliquely extending reinforcing straps attached at a first end thereof to said end door portion and having a second end constructed and arranged for attachment to a wall of said rigid container other than said rear door wall in such a manner that said interior reinforcing straps extend to be taut to support said flexible end door portion against outward bulging when said end door portion is so suspended and attached.

9. A flexible insert as recited in claim 8 wherein said bottom part of said container is secured substantially near a rear of said container.

10. A flexible insert as recited in claim 8 wherein said suspension members extending from said upper part of said end door portion, and said bottom part of said end door portion constructed and arranged for connection to said bottom part of said container, include said obliquely extending reinforcing straps.

11. A flexible insert as recited in claim 8 wherein said end door portion includes at least one retention loop structured and disposed to receive a free end of at least one of said reinforcing straps therethrough, subsequent to said reinforcing strap being looped through at least one cooperating suspension means element carried by said container, for subsequent securing thereof so as to further support said end door portion against bulging outward.

12. A flexible insert for installation within a container of generally rectangular configuration having a generally planar floor wall, a pair of generally planar side walls, a generally planar front end wall, and a generally planar closeable rear door wall extending upwardly from said floor wall, said insert comprising:

insert portions constructed and arranged to fit within said container and to be unfolded into a floor portion facing said floor wall and constructed and arranged to be supported on said floor wall, a pair of side wall portions facing said side walls and extending within said side walls, a front end portion facing said front end wall and extending within said front end wall and a rear end door portion facing said rear door wall and extending upwardly from said floor portion within said rear door wall, said insert being constructed and arranged to receive means to secure at least one of said insert portions to a facing container wall to prevent relative movement therebetween, insert suspension means comprising suspension means elements carried by said insert and cooperating suspension means elements carried by said container, at least one longitudinal reinforcing strap extending from a lower edge of said insert side walls, said longitudinal reinforcing strap being structured and disposed to prevent sliding movement of said floor portion towards said rear door wall upon elevation of said front end wall of said container for emptying of a cargo from said container, and said at least one longitudinal reinforcing strap including at least one obliguely extending reinforcing strap.

13. A flexible insert as recited in claim 12 wherein said longitudinal reinforcing strap extends at least partially along said lower edge of said insert.

14. A flexible insert as recited in claim 12 including a plurality of said longitudinal reinforcing straps extending from said lower edge of each of said insert side walls.

15. A flexible insert as recited in claim 12 wherein said longitudinal reinforcing strap extends beyond said front end portion of said insert.

16. A flexible insert as recited in claim 12 wherein said longitudinal reinforcing strap is secured to one of the walls of the container.

17. A flexible insert as recited in claim 12 wherein said longitudinal reinforcing strap extends entirely along said lower edge of said insert and beyond said front end portion of said insert.

18. A flexible insert as recited in claim 12 wherein said longitudinal reinforcing strap extends from said front end portion of said insert.

* * * * *